US006735406B1

(12) United States Patent
Noda

(10) Patent No.: US 6,735,406 B1
(45) Date of Patent: May 11, 2004

(54) PROCESS CARTRIDGE MOUNTING MECHANISM, ELECTROPHOTOGRAPHIC IMAGE FORMING APPARATUS, AND PROCESS CARTRIDGE

(75) Inventor: Shinya Noda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/685,002

(22) Filed: Oct. 6, 2000

(30) Foreign Application Priority Data

Oct. 8, 1999 (JP) ..... 11-287923
Sep. 18, 2000 (JP) ..... 2000-281861

(51) Int. Cl.[7] ..... G03G 15/00; G03G 21/16
(52) U.S. Cl. ..... 399/111; 399/114
(58) Field of Search ..... 399/110, 111, 399/113, 114, 116

(56) References Cited

U.S. PATENT DOCUMENTS

| | | | | |
|---|---|---|---|---|
| 5,331,372 | A | 7/1994 | Tsuda et al. | 355/200 |
| 5,402,212 | A | 3/1995 | Ito et al. | 355/210 |
| 5,404,198 | A | 4/1995 | Noda et al. | 355/200 |
| 5,463,446 | A | 10/1995 | Watanabe et al. | 355/200 |
| 5,470,635 | A | 11/1995 | Shirai et al. | 428/131 |
| 5,475,470 | A | 12/1995 | Sasago et al. | 355/210 |
| 5,488,459 | A | 1/1996 | Tsuda et al. | 355/211 |
| 5,510,878 | A | 4/1996 | Noda et al. | 355/211 |
| 5,583,613 | A | 12/1996 | Kobayashi et al. | 355/200 |
| 5,602,623 | A | 2/1997 | Nishibata et al. | 399/111 |
| 5,608,509 | A | 3/1997 | Shirai et al. | 399/351 |
| 5,623,328 | A | 4/1997 | Tsuda et al. | 399/111 |
| 5,640,650 | A | 6/1997 | Watanabe et al. | 399/117 |
| 5,659,847 | A | 8/1997 | Tsuda et al. | 399/113 |
| 5,669,042 | A | 9/1997 | Kobayashi et al. | 399/111 |
| 5,749,027 | A | 5/1998 | Ikemoto et al. | 399/113 |
| 5,774,766 | A | 6/1998 | Karakama et al. | 399/111 |
| 5,828,928 | A | 10/1998 | Sasago et al. | 399/111 |
| 5,878,310 | A | 3/1999 | Noda et al. | 399/117 |
| 5,890,036 | A | 3/1999 | Karakama et al. | 399/119 |
| 5,899,602 | A | 5/1999 | Noda et al. | 399/111 |
| 5,920,752 | A | 7/1999 | Karakama et al. | 399/111 |
| 5,930,562 | A | 7/1999 | Noda et al. | 399/114 |
| 5,943,528 | A | 8/1999 | Akutsu et al. | 399/110 |
| 6,115,565 | A | 9/2000 | Noda et al. | 399/102 |

FOREIGN PATENT DOCUMENTS

| | | |
|---|---|---|
| EP | 0 368 346 | 5/1990 |
| EP | 0 740 226 | 10/1996 |
| JP | 4-333066 | 11/1982 |
| JP | 6-43702 | 2/1984 |
| JP | 4-90561 | 3/1992 |
| JP | 7-199568 | 8/1995 |
| JP | 8-254862 | 10/1996 |
| JP | 11-167333 | 6/1999 |
| JP | 11-174933 | 7/1999 |
| JP | 2000-293087 | 10/2000 |

*Primary Examiner*—Fred L Braun
(74) *Attorney, Agent, or Firm*—Fitzpatrick, Cella, Harper & Scinto

(57) ABSTRACT

The invention relates to a process cartridge mounting mechanism for mounting a process cartridge to a mounting position in a main assembly of an electrophotographic image forming apparatus. The process cartridge mounting mechanism includes an openable cover mounted to the main assembly. The cover is opened and closed when the cartridge is mounted to or demounted from the main assembly. The mechanism also includes a first main assembly side guide, which is provided in the main assembly and which is movable in interrelation with opening and closing operation of the cover; a second main assembly side guide, which is movable in interrelation with opening and closing operation of the cover; a first cartridge guide, provided in the cartridge at one longitudinal end of a cartridge frame, for guiding the cartridge toward the mounting position; and a second cartridge guide, provided in the cartridge at one longitudinal end of a cartridge frame, for guiding the cartridge toward the mounting position. The cartridge is mounted to the mounting position in interrelations with a closing operation of the cover.

44 Claims, 24 Drawing Sheets

PROCESS CARTRIDGE MOUNTING MECHANISM, ELECTROPHOTOGRAPHIC IMAGE FORMING APPARATUS, AND PROCESS CARTRIDGE

FIELD OF THE INVENTION AND RELATED ART

The present invention relates to a process-cartridge mounting mechanism, an electrophotographic image forming apparatus and a process cartridge.

Here, the electrophotographic image forming apparatus is an apparatus which forms an image on recording materials through an electrophotographic image formation process. Examples of the electrophotographic image forming apparatus include an electrophotographic copying machine, an electrophotographic printer (a laser beam printer, an LED printer or the like), a facsimile machine and a word processor.

The process cartridge is a cartridge that contains as a unit an electrophotographic photosensitive member and a charging means, a developing means or a cleaning means in the form of a cartridge which is detachably mountable to a main assembly of an image forming apparatus. The process cartridge may contain an electrophotographic photosensitive member and at least one of a charging means, a developing means, and a cleaning means in the form of a cartridge which is detachably mountably to a main assembly of an image forming apparatus. The process cartridge may contain an electrophotographic photosensitive member and at least developing means in the form of a cartridge which is detachably mountably to a main assembly of an image forming apparatus.

Such a process-cartridge type is conventionally used. With this process-cartridge type, the maintenance of the apparatus can be carried out in effect by the user without a service person, so that operability is remarkably good. For this reason, the process-cartridge type is widely used in the field of image forming apparatus.

In order to provide good images in such an electrophotographic image forming apparatus using a process cartridge, the process cartridge is desirably mounted correctly at a predetermined position in the main assembly of the electrophotographic image forming apparatus, and the interface portions thereof, such as various electrical contacts and the drive transmitting mechanisms, are correctly connected.

Referring first to FIGS. 23 to 25, there is shown an example to accomplish these goals wherein for the mounting-and-demounting of a process cartridge CR relative to the main assembly P of the image forming apparatus, a positioning boss CB is provided coaxially with the photosensitive drum in the process cartridge CR, and a guide GL for guiding and positioning the positioning boss CB is provided in the main assembly P of the image forming apparatus. When the operator inserts the cartridge CR along the mounting guide GL to the predetermined position, the fixing member (unshown) provided in the main assembly P of the apparatus contacts to the cartridge CR, and the rotation thereof around the positioning boss CB is prevented, as is known.

Additionally, it is also known that cover member C of the main assembly P of the apparatus is provided with a spring for urging the cartridge CR mounted in the main assembly P in the mounting direction.

It is also known that back cover UC (FIG. 25) is provided inside the cover member C, and by closing the cover member C, the cartridge CR is pushed into the regular position.

The present invention is intended to provide a further development in this area.

SUMMARY OF THE INVENTION

Accordingly, it is a principal object of the present invention to provide a process-cartridge mounting mechanism, a process-cartridge mounting method, a process cartridge, and an electrophotographic image forming apparatus to which the process cartridge is detachably mountable, wherein the mounting operability at the time of mounting the process cartridge to the main assembly of the apparatus is improved.

It is another object of the present invention to provide a process-cartridge mounting mechanism, a process-cartridge mounting method, a process cartridge, and an electrophotographic image forming apparatus to which the process cartridge is detachably mountable, ,wherein the process cartridge can be substantially automatically mounted to a mounting position in the main assembly of the apparatus.

It is a further object of the present invention to provide a process-cartridge mounting mechanism, a process-cartridge mounting method, a process cartridge, and an electrophotographic image forming apparatus to which the process cartridge is detachably mountable, wherein the process cartridge can be mounted to the mounting position of the main assembly of the apparatus in interrelation with a closing operation of the cover member.

It is a further object of the present invention to provide a process-cartridge mounting mechanism, a process-cartridge mounting method, a process cartridge, and an electrophotographic image forming apparatus to which the process cartridge is detachably mountable, wherein the process cartridge can be automatically mounted to or demounted from the mounting position of the main assembly of the apparatus.

It is a further object of the present invention to provide a process-cartridge mounting mechanism, a process-cartridge mounting method, a process cartridge, and an electrophotographic image forming apparatus to which the process cartridge is detachably mountable, wherein the mounting-and-demounting operability, relative to the main assembly of the apparatus, of the process cartridge is improved.

According to an aspect of the present invention, there is provided a process-cartridge mounting mechanism for mounting a process cartridge to a mounting position in a main assembly of an electrophotographic image forming apparatus. The cartridge comprises an electrophotographic photosensitive member and process means actable on the photosensitive member. The process cartridge mounting mechanism comprises: an openable cover member mounted to the main assembly of the apparatus, the cover member being opened and closed when the cartridge is mounted to or demounted from the main assembly of the apparatus; a first main assembly side guide, which is provided in the main assembly of the apparatus and which is movable in interrelation with opening and closing operation of the cover member, the first main assembly side guide including a first supporting portion and a first urging portion; a second main assembly side guide, which is provided in the main assembly of the apparatus and which is movable in interrelation with the opening and closing operation of the cover member, the second main assembly side guide including a second supporting portion and a second urging portion; a first cartridge guide, provided in the cartridge at one longitudinal end of a cartridge frame, for guiding the cartridge toward the mounting position, the first cartridge guide including a first supported portion to be supported on the first supporting portion and a first urged portion to be urged to the first urging portion; and a second cartridge guide, provided in the cartridge at one longitudinal end of the cartridge frame, for guiding the cartridge toward the mounting position, the second cartridge guide including a second supported portion to be supported on the second supporting portion and a second urged portion to be urged to the second urging portion. The cartridge is mounted to the mounting position in interrelation with a closing operation of the cover member.

According to another aspect of the present invention, there is provided an electrophotographic image forming apparatus for forming an image of a recording material, to which a process cartridge is detachably mountable. The apparatus comprises: (a) an openable cover member mounted to the main assembly of the apparatus, the cover member being opened and closed when the cartridge is mounted to or demounted from the main assembly of the apparatus; (b) a first main assembly side guide which is provided in the main assembly of the apparatus and which is movable in interrelation with opening and closing operation of the cover member, the first main assembly side guide including a first supporting portion and a first urging portion; (c) a second main assembly side guide, which is provided in the main assembly of the apparatus and which is movable in interrelation with the opening and closing operation of the cover member, the second main assembly side guide including a second supporting portion and a second urging portion; and (d) mounting means for mounting a process cartridge. The process cartridge includes: process means actable on the electrophotographic photosensitive member; a first cartridge guide, provided in the cartridge at one longitudinal end of a cartridge frame, for guiding the cartridge toward the mounting position, the first cartridge guide including a first supported portion to be supported on the first supporting portion and a first urged portion to be urged to the first urging portion; a second cartridge guide, provided in the cartridge at one longitudinal end of the cartridge frame, for guiding the cartridge toward the mounting position, the second cartridge guide including a second supported portion to be supported on the second supporting portion and a second urged portion to be urged to the second urging portion. The cartridge is mounted to the mounting position in interrelation with a closing operation of the cover member.

According to a further aspect of the present invention, there is provided a process cartridge detachably mountable to a main assembly of an electrophotographic image forming apparatus for forming an image on a recording material. The image forming apparatus includes an openable cover member mounted to the main assembly of the apparatus. The cover member is opened and closed when the cartridge is mounted to or demounted from the main assembly of the apparatus. The apparatus also includes a first main assembly side guide, which is provided in the main assembly of the apparatus and which is movable in interrelation with the opening and closing operation of the cover member. The first main assembly side guide includes a first supporting portion and a first urging portion. The apparatus further includes a second main assembly side guide, which is provided in the main assembly of the apparatus and which is movable in interrelation with the opening and closing operation of the cover member. The second main assembly side guide includes a second supporting portion and a second urging portion. The apparatus also includes an electrophotographic photosensitive member, process means actable on the photosensitive member; a cartridge frame, and a first cartridge guide, provided in the cartridge at one longitudinal end of a cartridge frame, for guiding the cartridge toward the mounting position. The first cartridge guide includes a first supported portion to be supported on the first supporting portion and a first urged portion to be urged to the first urging portion. In addition, the apparatus comprises a second cartridge guide, provided in the cartridge at one longitudinal end of the cartridge frame, for guiding the cartridge toward the mounting position, the second cartridge guide including a second supported portion to be supported on the second supporting portion and a second urged portion to be urged to the second urging portion. The cartridge is mounted to the mounting position in interrelation with a closing operation of the cover member. According to this invention, the process cartridge can be moved toward the mounting position by the first main assembly side guide and the second main assembly side guide, and is movable in interrelation with the opening and closing operation of an opening and closing member or a cover member.

These and other objects, features and advantages of the present invention will become more apparent upon a consideration of the following invention taken in conjunction with the accompanying drawings.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments will be described in conjunction with the accompanying drawings.

In the following descriptions, the longitudinal direction of the process cartridge is a direction which crosses (substantially perpendicular to) the mounting-and-demounting direction of the process cartridge relative to the main assembly of the apparatus and which is parallel with the surface of the recording material and crosses (substantially perpendicular to) a feeding direction of the recording material. As regards the process cartridge and the main assembly of the apparatus, "left and right" is as seen from above the recording medium in the feeding direction of the recording material, and in the specification "right" is called "first", and "left" is called "second". In the process cartridge, the "upper surface" of the process cartridge is a surface which takes an upper position when the process cartridge is mounted to the main assembly of the apparatus, and the "lower surface" is a surface which takes a lower position when the process cartridge is mounted to the main assembly of apparatus.

A description will be provided as to an embodiment of the present in conjunction with the accompanying drawings.

In this embodiment, the process cartridge is mounted to a cartridge-mounting-portion material of the main assembly through an opening of a mounting-and-demounting mechanism of the electrophotographic image forming apparatus when an opening and closing member is in an opening position.

In a first half of the closing operation of the opening and closing member from a full opening state, a holding means for holding a mounting member moves the cartridge-mounting-portion material from a first position at which the process cartridge is detachably mountable to a second position at which the process cartridge is operable for image formation. In the latter half of an opening operation from a full-close position, the holding means moves the cartridge mounting portion material from the second position to the first position. By doing so, the process cartridge can be mounted to and demounted from the main assembly of the apparatus in interrelation with the opening and closing operation of the opening and closing member of the process cartridge.

First Embodiment

Figure 1:
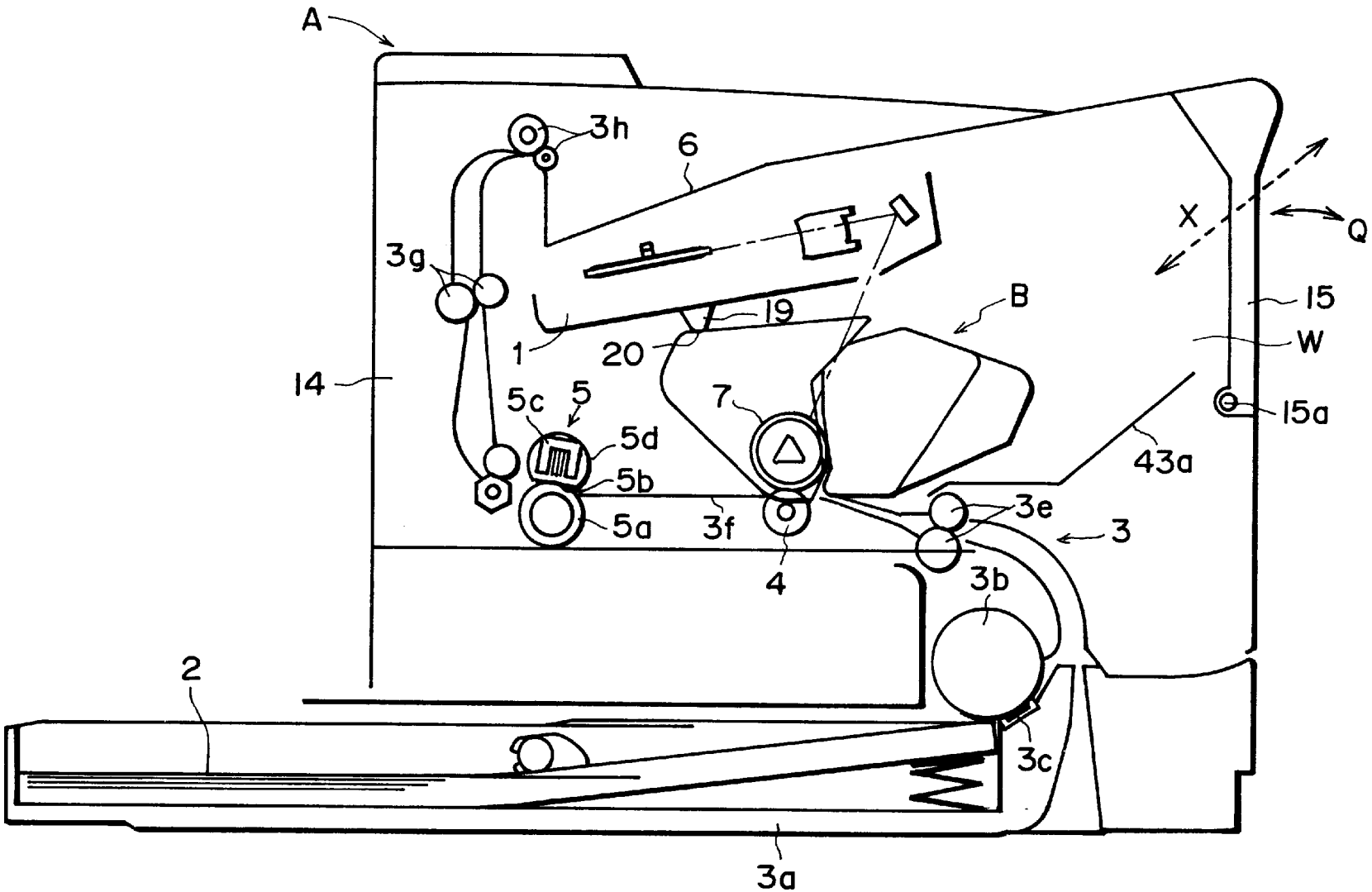
FIG. 1 is a schematic sectional view of an electrophotographic image forming apparatus.
Figure 2:
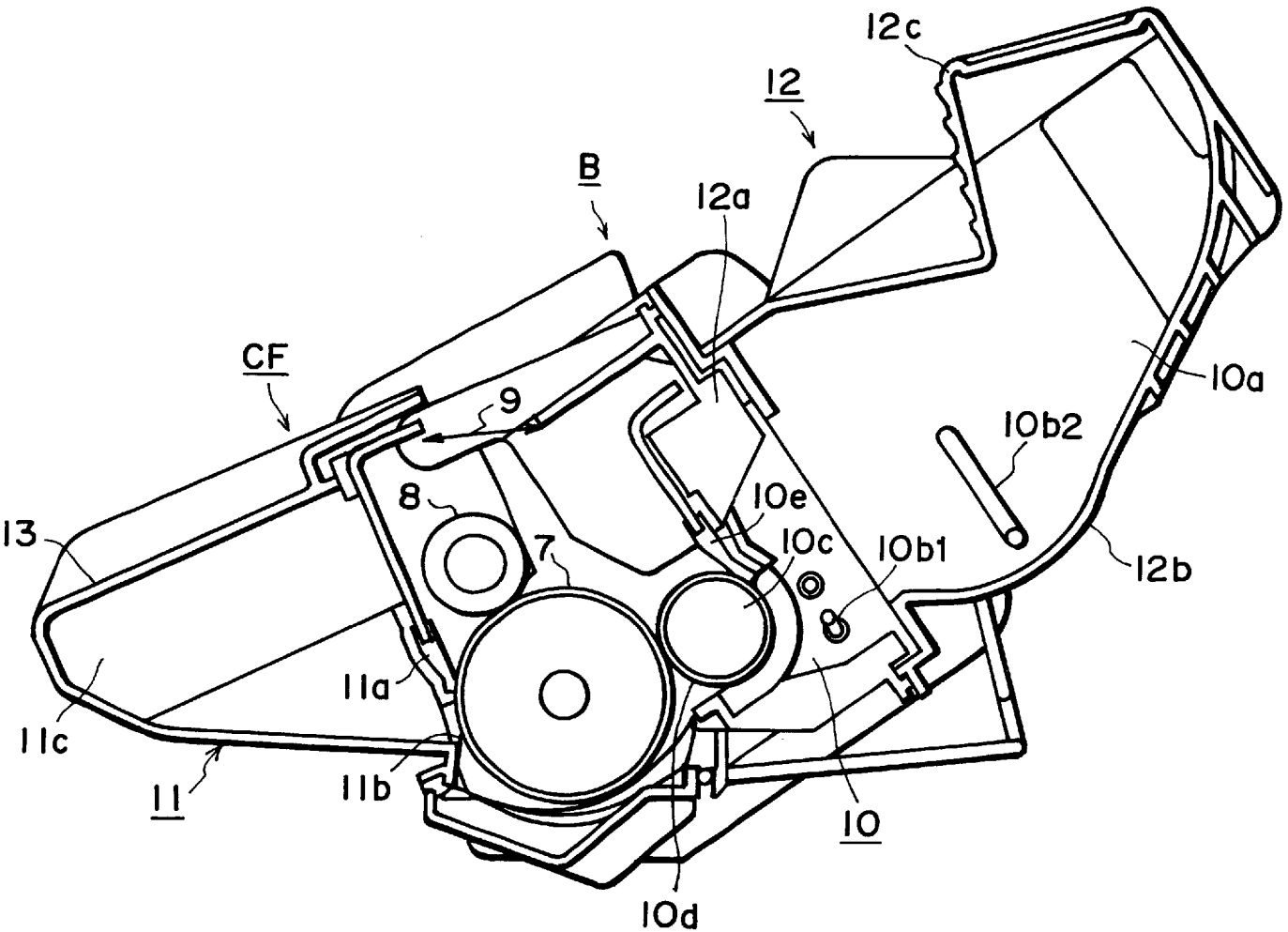
FIG. 2 is a schematic sectional view of a process cartridge.

Referring to FIGS. 1 and 2, the process cartridge and the electrophotographic image forming apparatus to which the process cartridge is detachably mountable will be described. FIG. 1 shows a general arrangement of the electrophotographic image forming apparatus to which the process cartridge is mounted, and FIG. 2 is a schematic illustration of the process cartridge.

The general arrangement of the process cartridge and the electrophotographic image forming apparatus will first be described, and the structure of the process cartridge mounting-and-demounting mechanism for the mounting and demounting of the process cartridge relative to the main assembly of the electrophotographic image forming apparatus, will be described.

(General Arrangement)

As shown in FIG. 1, in the electrophotographic image forming apparatus (laser beam printer, image forming apparatus), an information light modulated in accordance with image information is applied to the electrophotographic photosensitive member (photosensitive drum) 7 from an optical system 1 as optical means to form an electrostatic latent image on the photosensitive drum 7, and the electrostatic latent image is developed with developer (toner) into a toner image (visualized image). In synchronization with the formation of the toner image, a recording material (recording paper, an OHP sheet, a textile or the like) 2 is fed out of a cassette 3*a* by a pick-up roller 3*b* and a press-contact member 3*c* press-contacted thereto, and then the recording material is fed by registration rollers 3*e*. The toner image formed on the photosensitive drum 7 of the process cartridge B is transferred onto the recording material 2 by voltage application to the transfer roller 4 as transferring means. The recording material 2 is fed to fixing means 5 along a feeding guide 3*f*. The fixing means 5 contains therein a driving roller 5*a* and a fixing rotatable member 5*d* including a cylindrical sheet rotatably supported by a supporting member 5*c* and a heater 5*b* herein. It applies heat and pressure to the recording material 2 passing therethrough to fix the transferred toner image. The recording material 2 is further fed by a pair of discharging rollers 3*g* and 3*h*, and is discharged to a discharging portion 6 by way of a reverse feeding path. In this embodiment, the feeding means 3 is constituted by the pick-up roller 3*b*, the press-contact member 3*c*, the registration roller 3*e*, and so on.

(Process Cartridge)

On the other hand, the process cartridge B contains the electrophotographic photosensitive member and at least one process means. The process means may be charging means for charging the electrophotographic photosensitive member, developing means for developing an electrostatic latent image formed on the electrophotographic photosensitive member, cleaning means for removing the toner remaining on the electrophotographic photosensitive member, or the like. As shown in FIG. 2, in the process cartridge B of this embodiment, the photosensitive drum 7, which is an electrophotographic photosensitive member having a photosensitive layer, is rotated, and a voltage is applied to a charging roller 8, which is charging means to uniformly charge the surface of the photosensitive drum 7. The photosensitive drum 7 thus charged is exposed to information light (light image) modulated in accordance with image information emitted from the optical system 1 through an exposure opening 9 so that an electrostatic latent image is formed on the photosensitive drum, and the electrostatic latent image is developed by developing means 10.

The developing means 10 feeds the toner in the toner accommodating portion 10*a* by a rotatable first feeding member 10*b*2 and a second feeding member 10*b*1, which are toner feeding means. A developing roller 10*d,* which is a development rotatable member (developer carrying member) containing therein a fixed magnet 10*c,* is rotated, and a toner layer having a triboelectric charge is formed on the surface of the developing roller 10*d* by a developing blade 10*e*, and the toner is moved onto the photosensitive drum 7 in accordance with the electrostatic latent image, by which the toner image is developed into a visualized image.

The toner image is transferred onto the recording material 2 by the application of the voltage having an opposite polarity from the toner image to the transfer roller 4. Thereafter, the toner remaining on the photosensitive drum 7 is scrapped by a cleaning blade 11*a*, and the removed toner is received by a receptor sheet 11*b*, and cleaning means 11 for collecting the removed toner into a removed toner accommodating portion 11*c* removes the residual toner from the photosensitive drum 7.

The process cartridge B of this embodiment includes a cleaning frame 13 supporting the rotatably supported photosensitive drum 7, the cleaning means 11, and the charging roller 8, and a toner developing device frame 12 supporting the developing means 10 and the toner accommodating portion 10*a*. The toner developing device frame 12 is supported for rotation relative to the cleaning frame 13 so that the developing roller 10*d* of the developing means 10 can be opposed in parallel to the photosensitive drum 7 with a predetermined clearance therebetween, and spacers for maintaining a gap between the developing roller 10*d* and the photosensitive drum 7 with a predetermined pressure.

The photosensitive drum 7, the charging roller 8, the developing roller 10*d*, the cleaning blade 11*a,* and so on are accommodated in a cartridge frame (cartridge frame) CF provided by connecting the cleaning frame 13 and the toner developing device frame 12 which is integrated by welding the developing device frame 12*a*, the lower frame 12*b* and the cap member 12*c*, into a form of a cartridge, and the cartridge is detachably mountable to the main assembly of the electrophotographic image forming apparatus 14 in the direction of arrow X.

(Mounting-and-demounting Mechanism for Process Cartridge)

Figure 3:
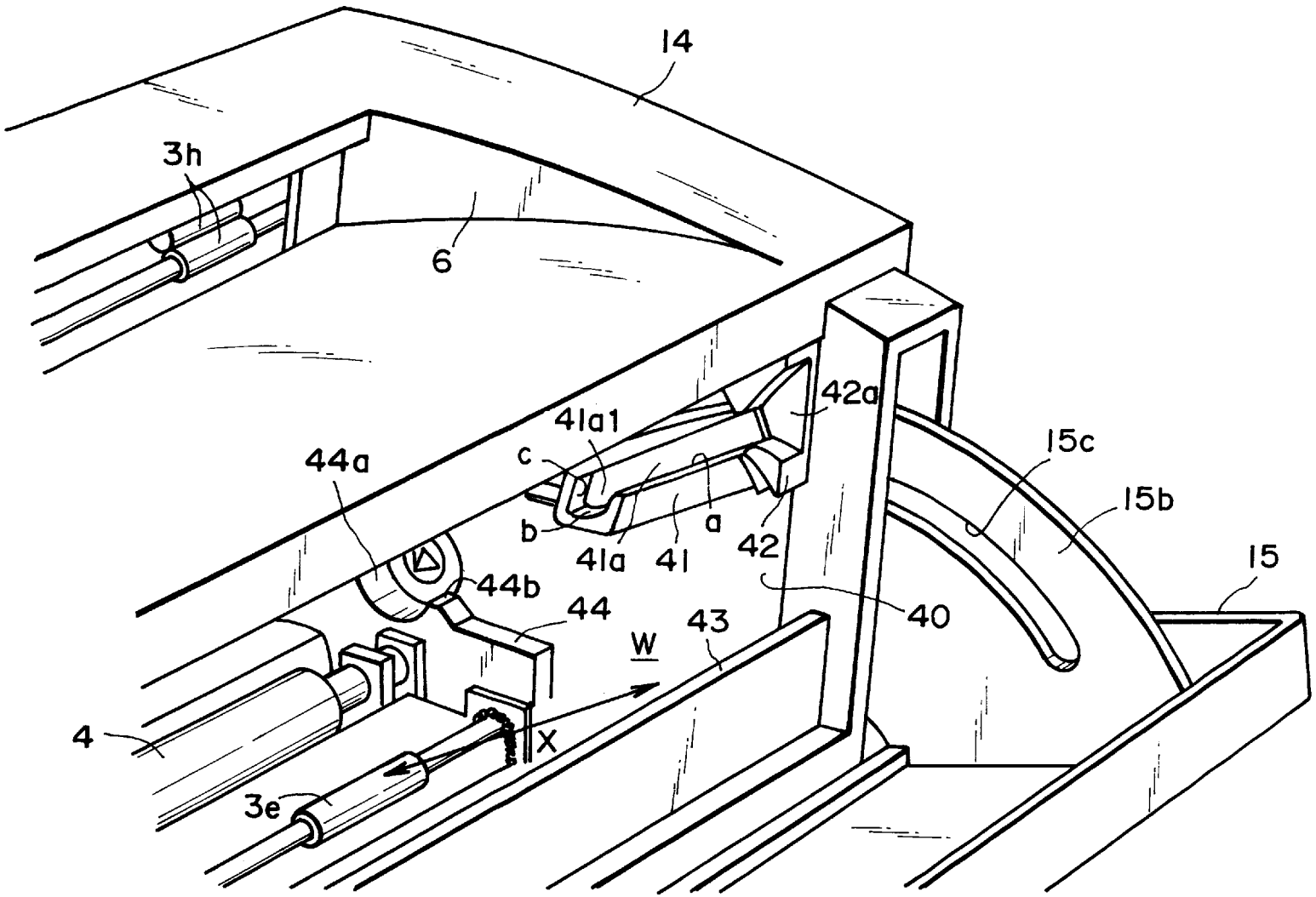
FIG. 3 is a perspective view of a process cartridge mounting-and-demounting mechanism according to an embodiment of the present invention.
Figure 7:
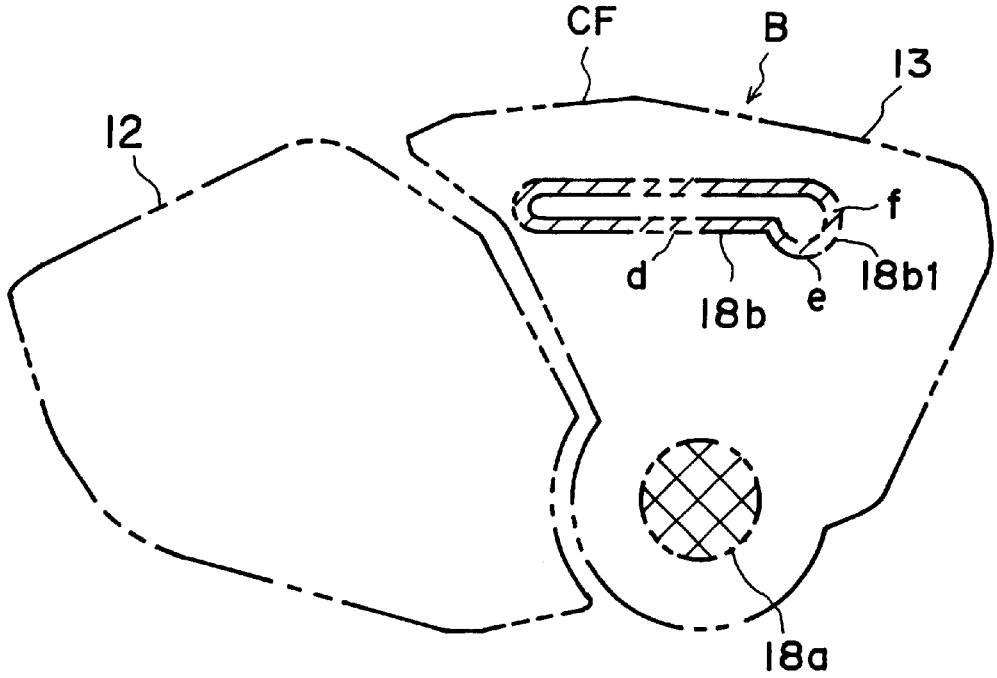
FIG. 7 is an illustration of a cartridge guide and a positioning portion at the left side of the process cartridge.

Referring to FIGS. 3 and 7, a description will be provided as to a process cartridge mounting-and-demounting mechanism for mounting the process cartridge B to the main assembly 14 of the image forming apparatus and demounting of the process cartridge B from the main assembly 14.

Figure 4:
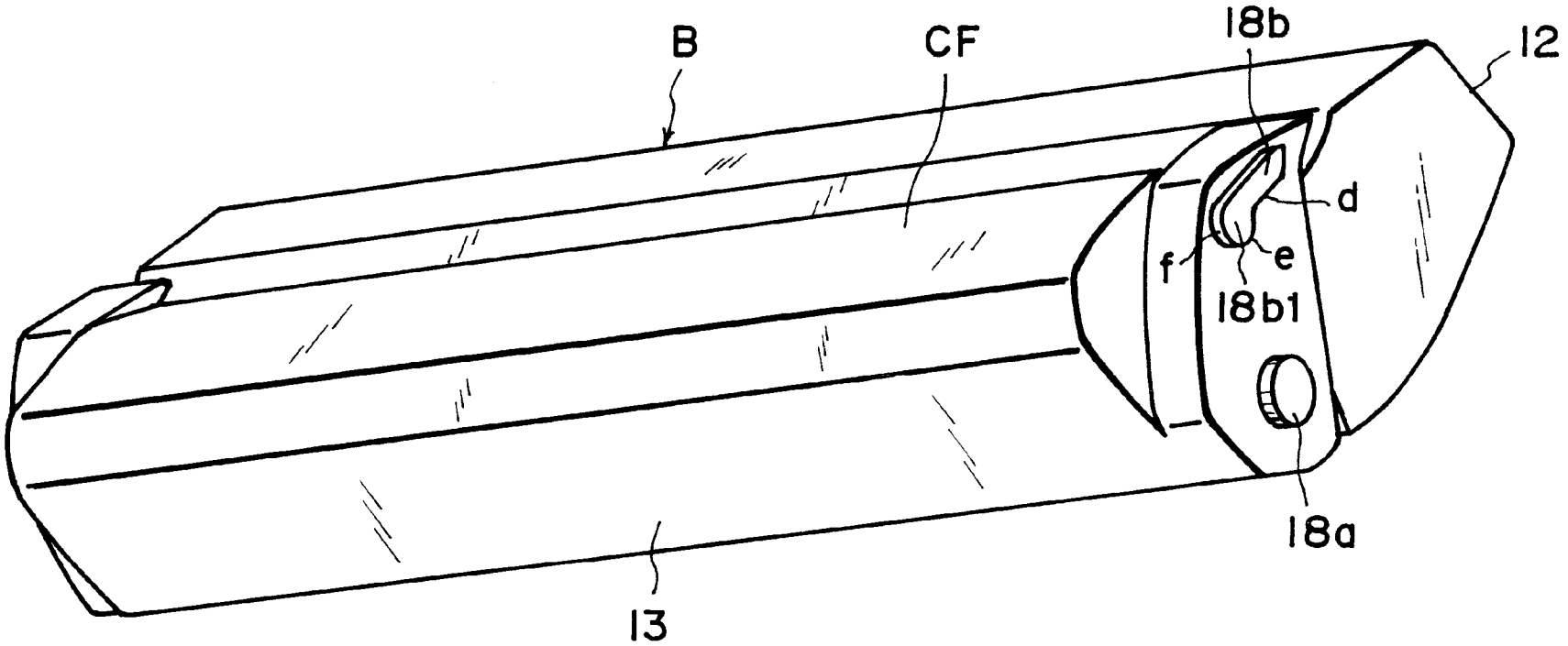
FIG. 4 is a perspective view of a process cartridge.
Figure 5:
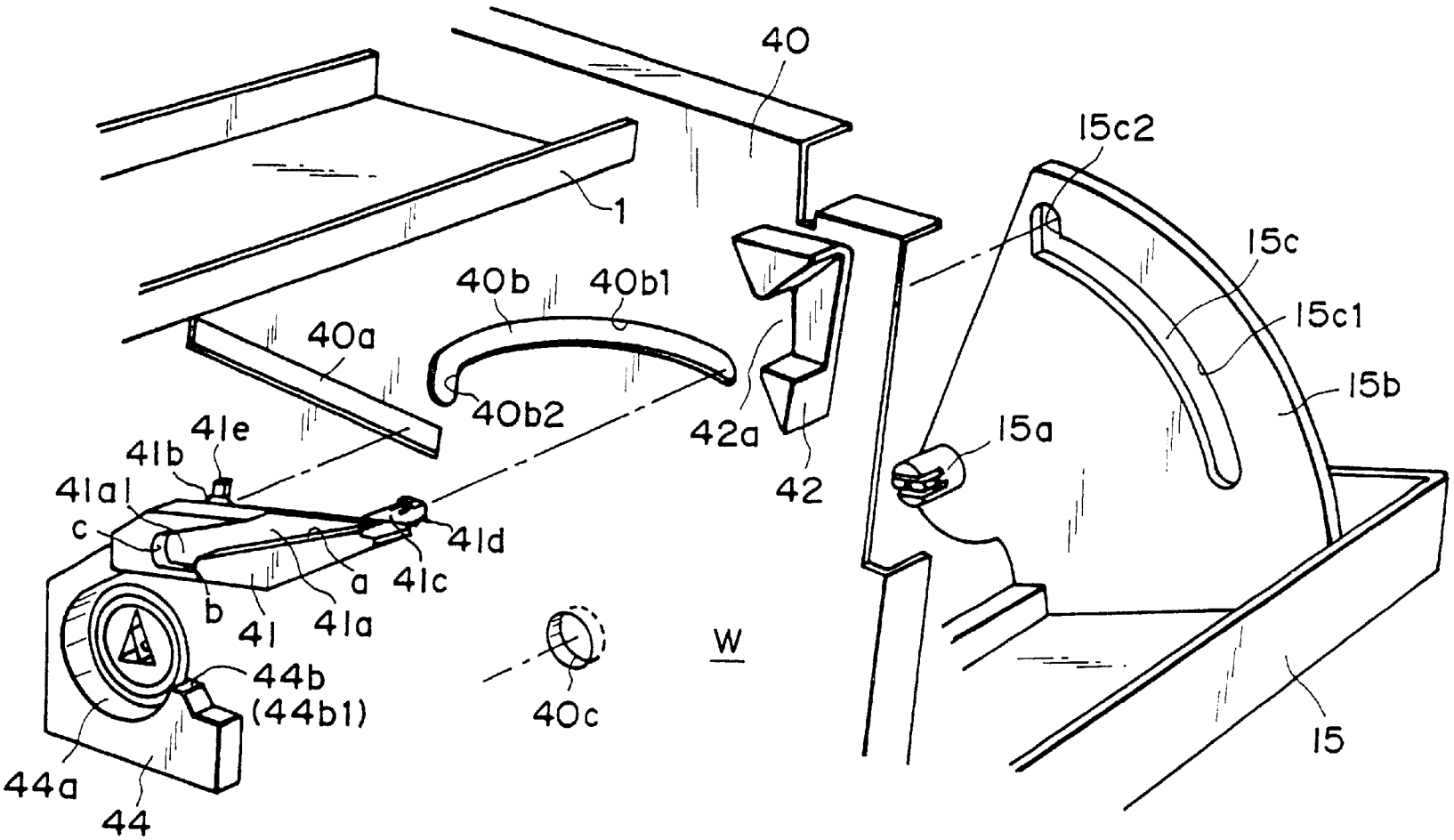
FIG. 5 is an exploded perspective view of the process cartridge mounting-and-demounting mechanism shown in FIG. 3.
Figure 6:
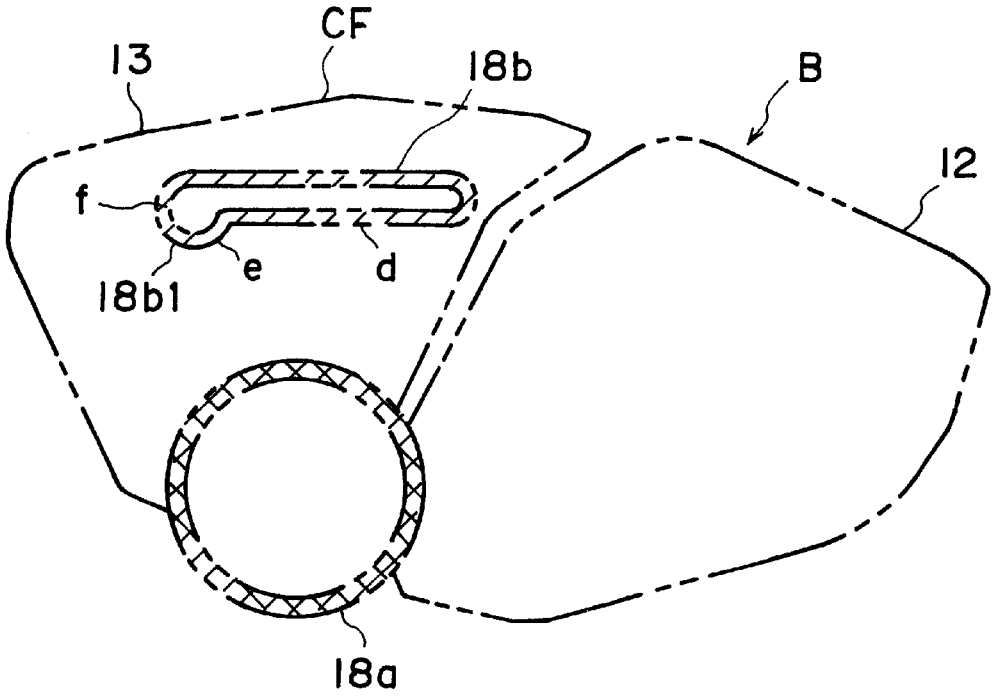
FIG. 6 is an illustration of a cartridge guide and a positioning portion at the right side of the process cartridge.

FIG. 3 is a perspective view of a process cartridge mounting-and-demounting mechanism as seen from the righthand side in the mounting direction of the process cartridge; FIG. 4 is a perspective view of the process cartridge; FIG. 5 is an exploded perspective view of a process cartridge mounting-and-demounting mechanism shown in FIG. 3; FIG. 6 is an illustration of a cartridge guide provided at the right side of the process cartridge and a positioning portion; and FIG. 7 is an illustration of a cartridge guide provided at the left side of the process cartridge and a positioning portion.

The mounting and demounting of the process cartridge B is carried out by opening the opening and closing member (opening cover) 15 as shown in FIG. 3. When the member 15 is opened, an opening W for permitting mounting and demounting of the process cartridge B is exposed. The opening W is defined by a front plate 43 extended in the longitudinal direction of the process cartridge B and first and second fixed members of a main assembly (left and right inner plates) 40, which are side plates opposed to each other in the longitudinal direction (the direction of the axis of the photosensitive drum 7) of the process cartridge B in the main assembly 14 of the image forming apparatus. The opening W is large enough to permit mounting of the process cartridge B from the cleaning frame 13 in a direction of arrow X. On the inner surfaces of the first and second fixed members of the main assembly 40 (left and right), there are provided first and second main-assembly-side guides (mounting-and-demounting guides) 41 functioning as cartridge-mounting-portion materials, and front guides 42 functioning as entrance guides, and they are symmetrically disposed, respectively.

The first and second main-assembly-side guides 41 are provided with guide grooves 41*a* functioning as guide portions on the surfaces defining the opening W. The guide grooves 41*a* are inclined downwardly toward the inside of the apparatus to facilitate mounting of the cartridge B in a direction crossing the feeding direction of the recording material 2. The first and second cartridge guides (guiding ribs) of the cartridge B (portions to be guided) 18*b*, when the cartridge B is mounted through the opening W, are engaged into the guide grooves 41*a* of the main-assembly-side guide 41. By this, the guide 41 holds the process cartridge B. The main-assembly-side guide 41 includes a recess 41*a*1 at a trailing edge of the guide groove 41*a*, and the projection 18*b*1 at the front end of the cartridge guide 18*b* is easily engaged into the recess 41*a*1. By doing so, the guide 41 holds the process cartridge B stationarily. In each of the first and second main-assembly-side guides 41, designated by a are first and second supporting portions, designated by b are first and second urging portions, and designated by c are guide regulating portions.

The front guide 42 is disposed upstream of the main assembly side guide 41 in the mounting direction X of the cartridge B. It is provided with a guide groove 42*a,* which is continuous with the guide groove 41*a* of the main-assembly-side guide 41 in the mounting direction X of the process cartridge B, in a side facing the opening W. The front guide 42, when the process cartridge B is inserted through the opening W, functions to guide the cartridge guide 18*b* of the cartridge B into the guide groove 42*a*. In this manner, the guide 42 guides the process cartridge B into the main-assembly-side guide 41.

A front plate 43 is disposed downstream of the opening W. It is provided on an upper surface facing the opening W with an inclined surface 43*a* having an inclination substantially equal to the inclination of the guide grooves 41*a*, 42*a* of the main-assembly-side guide 41 and the front guide 42.

A transfer roller 4 is disposed at a rear side in the mounting direction X of the cartridge B toward the main assembly 14 of the apparatus. Above a neighborhood of the axial end of the transfer roller 4, there is provided a positioning guide 44 for correctly positioning and supporting the cartridge B at an image-forming-operation position of the cartridge B (mounting completion position (second position)). The positioning guide 44 is fixed to the first or second fixed member of the main assembly 40 of the main assembly 14 of the apparatus. The guide 44 includes first and second main-assembly-side positioning portions 44*a* which are engageable with first and second positioning portions (positioning bosses) 18*a* of the cartridge B, which will be described hereinafter, and first and second regulating portions of the main assembly (projections) 44*b* entering a movement locus of the positioning portions 18*a* toward the main-assembly-side positioning portions 44*a*. Designated by g is a positioning-portion-entrance opening of the main-assembly-side positioning portion 44*a*. The regulating portion 44*b* of the main assembly is disposed upstream of the movement locus of the cartridge B toward the image-forming-operation position, that is, upstream of the main-assembly-side positioning portion 44 with respect to a moving direction from the first position to the second position of the main-assembly-side guide 41. The regulating portion 44*b* has a height so that the positioning portion 18*a* abuts it and rides over it.

As shown in FIG. 5, the main-assembly-side guide 41 has a first engaging member (projected guide) (boss) 41*c* and a second engaging member (boss) 41*b* on the side opposite from the guide groove 41*a*. The second engaging member 41*b* is disposed downstream of the guide groove 41*a* in the mounting direction X of the cartridge B. The first engaging member 41*c* is disposed upstream of the guide groove 41*a* in the mounting direction X of the cartridge B. The first engaging member 41*c* is taller than the second engaging member 41*b*. At the front end of the second engaging member 41*b*, there is provided a projection 41*e* projected in the radial direction of the engaging member 41*b*. At the front end of the first engaging member 41*c*, there is provided a snap fitting claw 41*d* which is capable of elastic deformation in the radial direction of the engaging member 41*c*.

The fixed member 40 of the main assembly 14 is provided with two guiding rails 40*a*, 40*b* functioning as holding means for the mounting member, for slidable engagement with the engaging members 41*b*, 41*c* of the main-assembly-side guide 41, independently from each other. The widths of the guiding rails 40*a*, 40*b* (inner diameters measured along the short sides are equal to or slightly larger than the diameters of the engaging members 41*b*, 41*c*. The main-assembly-side guide 41 is moved between the optical system 1 and the feeding path for the recording material 2 by the two engaging members 41*b*, 41*c* of a main-assembly-side guide 41 and the two guiding rails 40*a*, 40*b*. The first guiding rail 40*a* with which the second engaging member 41*b* is engaged is linear, and is inclined in a direction crossing with the mounting direction X of the cartridge B from above the positioning guide 44. The second guiding rail 40*b* with which the first engaging member 41*c* is engaged is provided with a first main-assembly-hole portion (first arcuate portion) 40*b*1 projected outwardly and arcuately about the rotation shaft 15*a*, which is a center of rotation of the opening and closing member 15. The rail 40*b* has a second main-assembly-hole portion (second arcuate portion) 40*b*2 having a center (unshown) adjacent a positioning guide 44 side end of the first guiding rail 40*a* having a radius equal to a gap between the two engaging members 41*b*, 41*c* of the main-assembly-side guide 41, continuing with the first main-assembly-hole portion 40*b*1.

Adjacent the opposite longitudinal (longitudinal direction of the cartridge B) ends of a member 15, there are provided first and second plates 15*b* (sector plates) in the form of a plate having a rotation shaft 15*a* for the member 15. The sector plate 15*b* is provided with a cam groove 15*c* which has a first plate-hole portion (arcuate groove) 15*c*1 extending circularly about a center of rotation (rotation shaft 15*a*), and a second plate-hole portion (linear groove) 15*c*2, which is formed continuing from a closing-direction-side end of the first plate-hole portion 15*c*1 and inclined in the closing direction from the radial direction of the first plate-hole portion 15*c*1. The first plate-hole portion 15*c*1 has a radius which is smaller than that of the first main-assembly-hole portion 40*b*1, and the distance between the front end of the second plate-hole portion 15*c*2 and the rotation shaft 15*a* is substantially equal to the radius of the first main-assembly-hole portion 40*b*1.

The opening and closing member 15 and the main-assembly-side guide 41 are assembled into the fixed member 40 of the main assembly.

The opening and closing member 15 is rotatably supported on the main assembly 14 of the apparatus by elastically deforming the sector plate 15*b* in the longitudinal direction of the cartridge B and engaging the rotation shaft 15*a* into the engaging hole 40*c* (FIG. 5) of the fixed member 40 of the main assembly. The member 15 is rotated in the direction of the arrow Q shown in FIG. 1 about the rotation shaft 15*a* to open and close the opening W.

The main-assembly-side guide 41 is mounted in the following manner. The projection 41*e* at the front end of the second engaging member 41*b* is aligned (longitudinal direction) with and inserted into the groove of the first guiding rail 40*a*, and then is rotated. By doing so, the projection 41*e* is engaged with the back side of the main-assembly fixed member 40, so that it functions as a retainer. Then, the first engaging member 41*c* penetrates through the second guiding rail 40*b*, and is engaged with the cam groove 15*c* of the member 15. By doing so, the snap fitting claw 41*c* provided at the front end of the first engaging member 41*c* is locked at the back side of the sector plate 15*b*.

On the other hand, a side surface (left and right) of a cartridge frame CF of the cartridge B is provided with first and second cartridge guides 18*b* to be engaged with the guide grooves 41*a*, the first and second main-assembly-side guides 41, and first and second positioning portions 18*a*, disposed on an extension line of the rotation shaft of the photosensitive drum 7, for engagement with the first and positioning portions 44*a*.

In the first and second cartridge guides 18*b*, designated by d are first and second portions to be supported (supported portion), and designated by e are first and second urged portions. They correspond to first and second supported portions a and first and second urging portions b, respectively.

Referring to FIGS. 8 to 14, a description will be provided as to the mounting-and-demounting operation of the cartridge B relative to the mounting-and-demounting mechanism for the cartridge.

Figure 8:
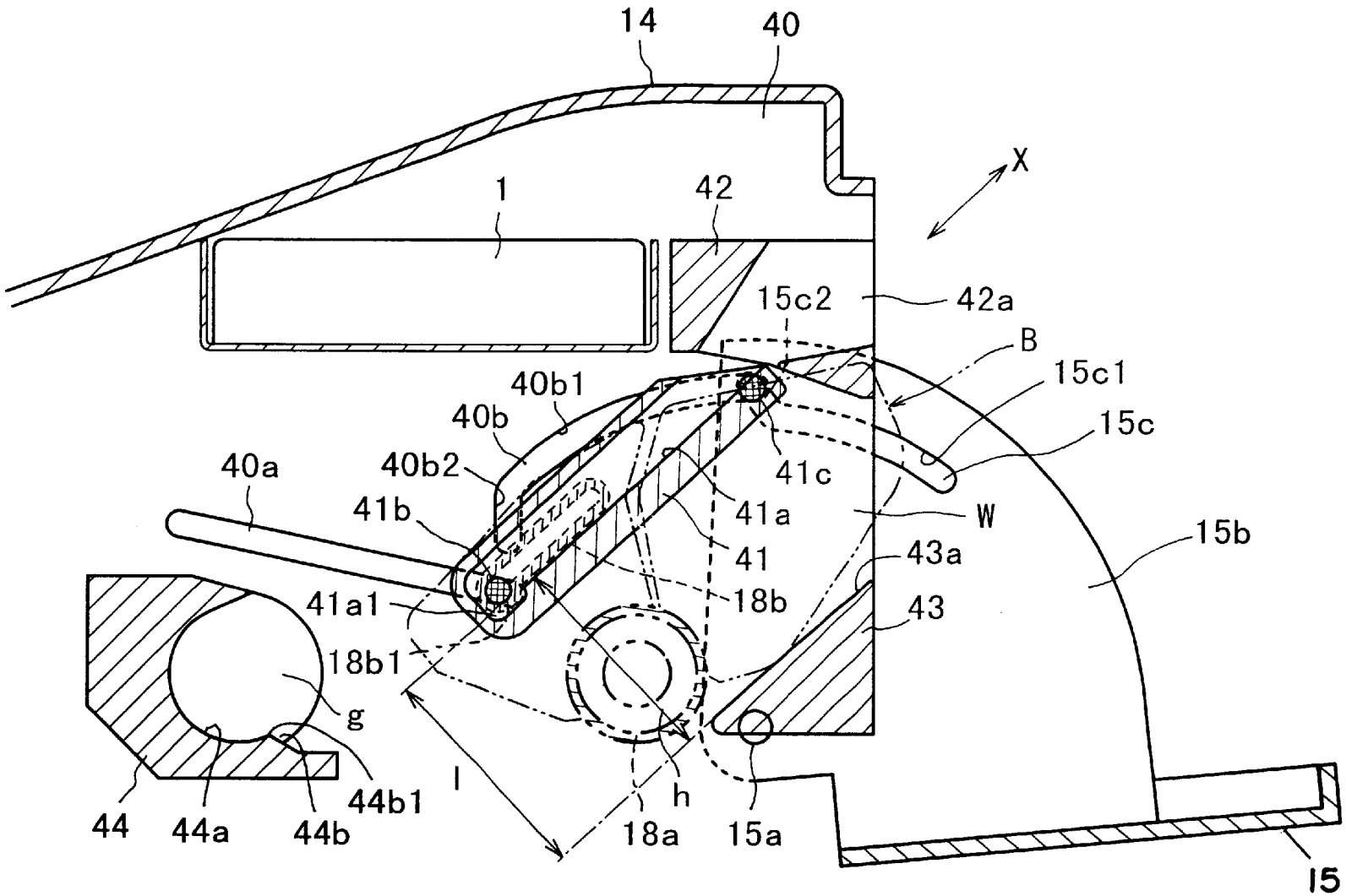
FIG. 8 is an illustration of an operation of the process cartridge mounting-and-demounting mechanism shown in FIG. 3.
Figure 9:
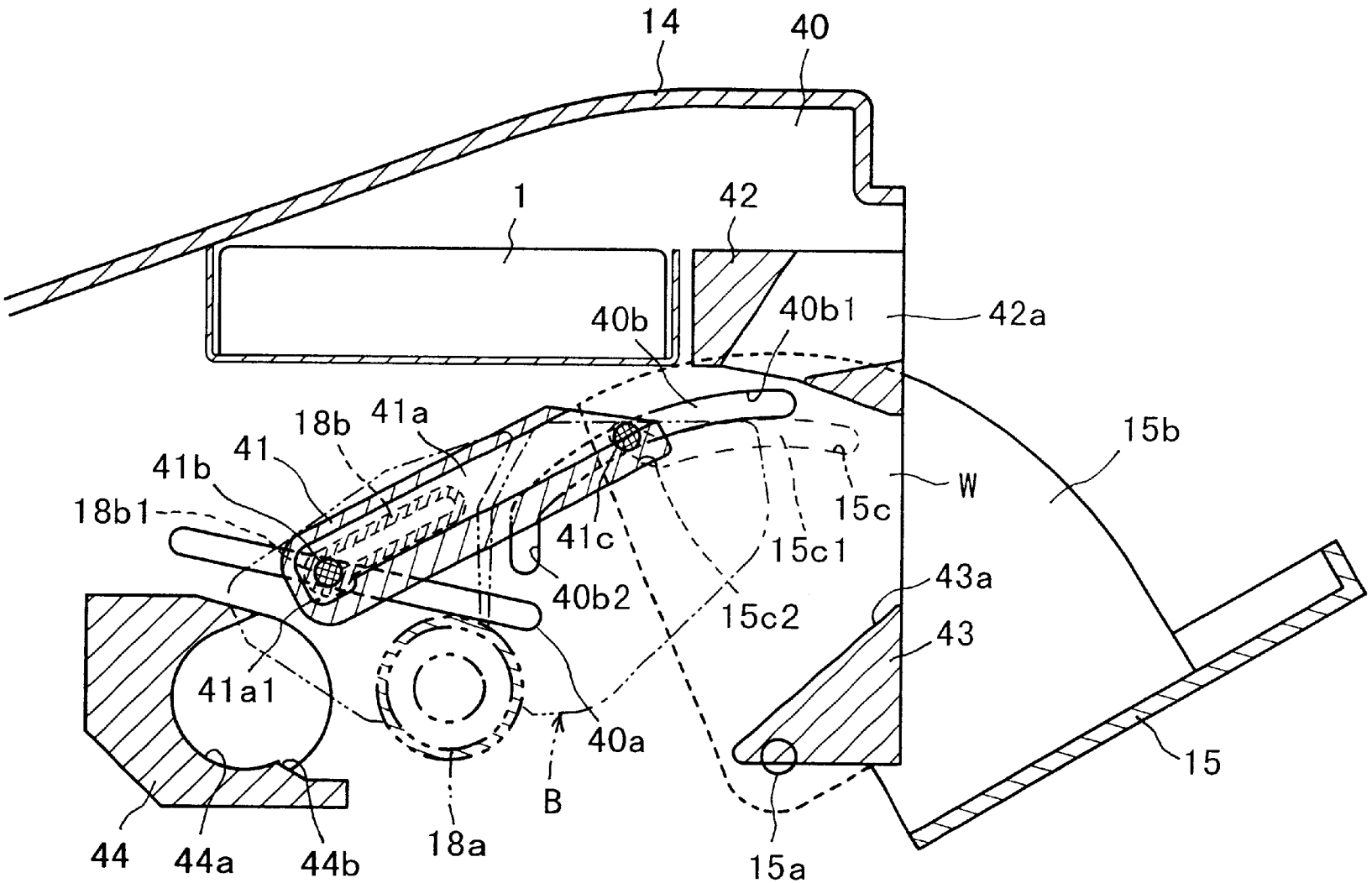
FIG. 9 is an illustration of an operation of the process cartridge mounting-and-demounting mechanism shown in FIG. 3.

When the opening and closing member 15 of the main assembly 14 of the apparatus is opened completely (full-open state), the front guide 42 and the main assembly side guide 41, which are continued, are exposed, as shown in FIG. 8. Here, the guide groove 42*a* of the front guide 42 and the guide groove 41*a* of the main-assembly-side guide 41 are continuous. With this continuing state, the operator inserts the cartridge B so that cartridge guide 18*b* is guided along the guide groove 42*a*, 41*a* in this order. And, it is inserted until the guide 18*b* abuts the trailing edge of the guide groove 41*a*. The main-assembly-side guide 41 is inclined downward in the mounting direction. Therefore, the weight of the cartridge B is effective to move the cartridge in the inserting direction.

In other words, the process cartridge is inserted until the abutting portion f of the guide 18*b* abuts the guide regulating portion c of the main-assembly-side guide 41. Then, the projection 18*b*1 of the guide 18*b* (FIG. 8) is engaged with the recess 41*a*1 of the guide groove 41*a*, so that supported portion d of the guide 18*b* is received by the supporting portion a of the main-assembly-side guide 41. The urged portion e of the guide 18*b* is disposed corresponding to the urging portion b of the main-assembly-side guide 41, by which the cartridge B is disposed stationarily relative to the main assembly side guide 41.

Thus, the cartridge B is mounted to the main-assembly-side guide 41 when the guide groove 41*a* is continuous with the guide groove 42*a* of the front guide 42 (first position). Here, the main assembly side guide 41 is inclined downward in the mounting direction X of the cartridge B into the guide groove 41*a* so that it crosses the feeding direction of the recording material 2 by the feeding means 3 (first pose) at the position where the guide groove 41*a* is continuous with the guide groove 42*a*.

This is accomplished by positioning the first engaging member 41*c* at the front end portion or leading end portion of the second plate hole portion 15*c*2, and positioning the second engaging member 41*b* at the lower end of the first guiding rail 40*a* (the opening side W end) when the member 15 is in the full-open position. As shown in FIG. 8, the height h of the guide 18*b* from the bottom surface (lower surface) of the cartridge B is substantially equal to the interval 1 between the inclined surface 43*a* of the front plate 43 and the guide groove 41*a*. Therefore, when the bottom surface of the cartridge B is placed on the inclined surface 43*a* of the plate 43, the cartridge guide 18*b* is spontaneously guided by the guide groove 41*a* of the main assembly side guide 41.

In addition, the guide grooves 41*a*, 42*a* are inclined downward toward the front. Therefore, when the cartridge guides 18*b* are guided by the guide grooves 41*a*, 42*a*, the cartridge B is led toward the rear of the main-assembly-side guide 41 by the weight of the cartridge B.

A description will be provided as to the inclination of the guide grooves 41*a*, 42*a*. If the inclination of the guide grooves 41*a*, 42*a* is too small, the cartridge B is not led toward the rear side of the main-assembly-side guide 41. If it is too large, on the contrary, the impact is significant when the operator releases the cartridge B halfway through insertion along the main-assembly-side guide 41. In view of these factors, the inclination angle is preferably 10°–70° from the horizontal direction. In this embodiment, the inclination angle of the guide grooves 41*a*, 42*a* is approximately 40° from the horizontal direction.

The main-assembly-side guide 41 in this embodiment is moved in interrelation with the opening and closing operation of the cover member 15. Therefore, if the main-assembly-side guide 41 is pushed by the cartridge B, the main-assembly-side guide 41 moves. Therefore, the height of the bottom surface of the cartridge B to the guide 18*b* changes relative to the distance between the guide groove 41*a* and the inclined surface 43*a* of the plate 43. This causes operability to deteriorate. In addition, if the main-assembly-side guide 41 is moved through a large distance, the guide 18*b* of the cartridge B passes beyond the lower surface of the main-assembly-side guide 41 with the result that cartridge B would fall into the main assembly 14 of the apparatus. For this reason, in this embodiment, there is provided a front guide 42 which is continuous with the guide groove 41*a* of the main-assembly-side guide 41 and which is fixed to the main-assembly fixed member 40 at a position upstream of the main-assembly-side guide 41 in the mounting direction X of the cartridge. By the provision of the front guide 42, the problem is solved, and the guide 18*b* is guided into the guide groove 41*a* of the main-assembly-side guide 41 with certainty. The front guide 42 is not inevitable although it is effective to improve operability.

Referring to FIGS. 8 to 12, a description will be provided as to the movement of the cartridge B whose guide 18*b* is supported by the main-assembly-side guide 41 in accordance with the process of the closing action of the opening and closing member 15.

When the member 15 is closed by rotation about the rotation shaft 15*a*, the first engaging member 41*c* is moved along the first main-assembly-hole portion 40*b*1 at the front end side of the second plate-hole portion 15*c*2. As described in the foregoing, the first main-assembly-hole portion 40*b*1 has its center at the rotation shaft 15*a* of the member 15 and has a radius which is equal to the distance to the front end of the second plate-hole portion 15*c*2 of the cam groove 15*c*. Accordingly, the first engaging member 41*b* is also moved toward the rear side in the mounting direction X of the cartridge B along the first guiding rail 40*a*. At this time, the main-assembly-side guide 41 moves toward the rear side while rotating in the clockwise direction, by which the pose of the cartridge B is changed toward that for the image forming operation.

Figure 10:
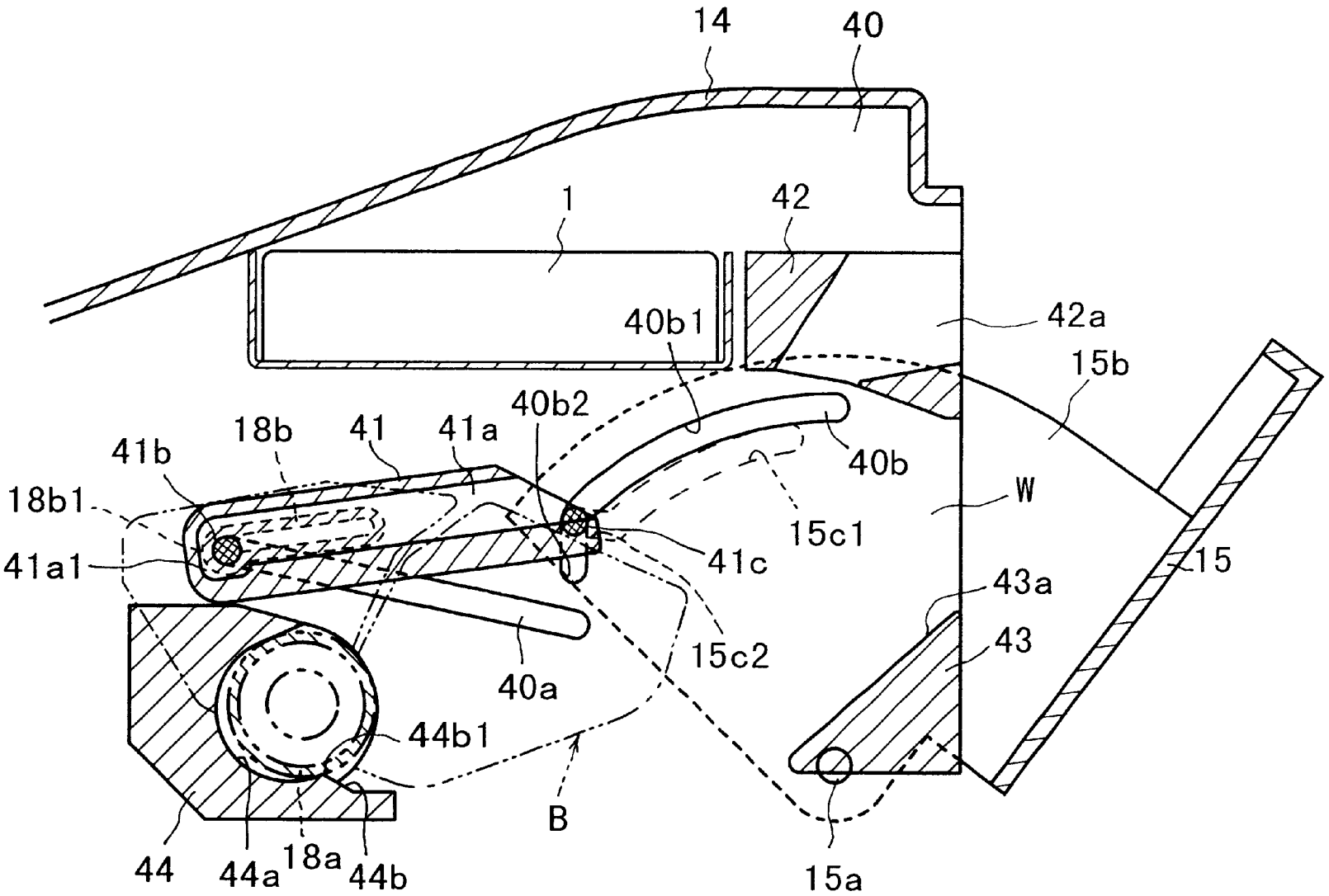
FIG. 10 is an illustration of an operation of the process cartridge mounting-and-demounting mechanism shown in FIG. 3.

With the further closing action of the member 15, the cartridge B approaches the horizontal pose, while approaching the image-forming-operation position at the rear side of the main assembly 14 of the apparatus. Then, the outer periphery of the positioning portion 18*a* of the cartridge B is brought into abutment to the main-assembly-side-regulating portion (projection) 44*b* provided at a position upstream of the positioning portion 44*a* of the main assembly in the movement locus of the cartridge B to the image-forming-operation position (FIG. 10).

When the member 15 is further closed, the main-assembly-side guide 41 further approaches the image-forming-operation position, and the recess 41*a*1 of the guide groove 41*a* pushes the projection 18*b*1 of the guide 18*b*. That is, the urging portion b at the main-assembly-side guide 41 side presses against the urged portion e at the cartridge guide. 18*b* side so that the positioning portion 18*a* rides over the main-assembly-side-regulating portion 44*b* of the positioning guide 44. The positioning portion 18*a* falls by the weight of the process cartridge B through the difference between the apex 44*b*1 of the main-assembly-side-regulating portion 44*b* and the positioning portion 44*a* of the main assembly after the positioning portion 18*a* is beyond the main-assembly-side regulating portion 44*b*.

Then, the cartridge B, which has been supported by the guide 18*b* in the guide groove 41*a*, is now supported by the positioning portion 18*a* provided on the axis of the rotation shaft of the photosensitive drum 7 by the positioning portion 44*a* of the main assembly. As described in the foregoing, by supporting the positioning portion 18*a* provided on the axis of the photosensitive drum 7 by the positioning portion 44*a* in the main assembly fixed to the main-assembly fixed member 40 of the main assembly 14, the cartridge B is correctly positioned in the main assembly 14. Therefore, the process cartridge is correctly positioned with proper alignment with the optical system 1, the transfer roller 4, and so on, which require correct positioning relative to the photosensitive drum 7 in the process cartridge.

A description will be provided as to the movements of the main-assembly-side guide 41 and the opening and closing member 15. As shown in FIG. 10, when the positioning portion 18*a* of the cartridge B rides over the main-assembly-side regulating portion 44*b*, the pressing of the cartridge B by the recess 41*b*1 of the main assembly side guide 41 is completed substantially. At this time, the first engaging member 41*c* is exposed at the contact (intersection) between the first main-assembly-hole portion 40*b*1 and the second main-assembly-hole portion 40*b*2. The second engaging member 41*b* is disposed at an upper end of the first guiding rail 40*a* (rear side end of the process cartridge B in the mounting direction). By doing so, the main-assembly-side guide 41 takes such a position that guide groove 41*a* is substantially parallel with the feeding direction of the recording material 2 by the feeding means 3 at the image-forming-operation position of the cartridge B. That is, the main-assembly-side guide 41 is different from the pose of the first position, at the second position.

Figure 11:
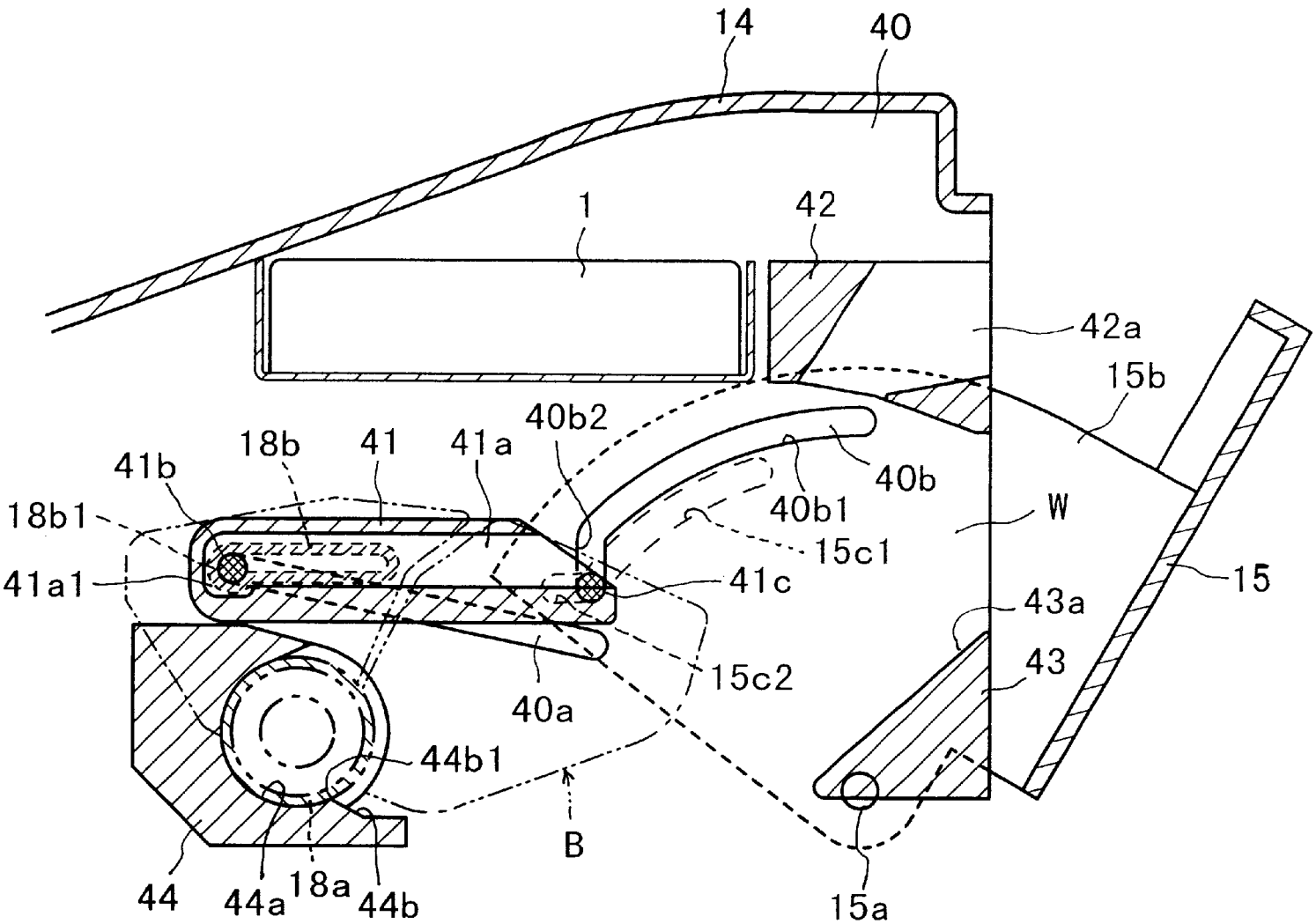
FIG. 11 is an illustration of an operation of the process cartridge mounting-and-demounting mechanism shown in FIG. 3.

By this, the member 15 is further closed. Then, as shown in FIG. 11, the inclination of the second plate-hole portion 15*c*2 moves the first engaging member 41*c* to the second main-assembly-hole portion 40*b*2. As described in the foregoing, the second main-assembly-hole portion 40*b*2 has its center on the first guiding rail 40*a*, and has a radius that is equal to the interval between the first and second engaging members 41*c*, 41*b* of the main-assembly-side guide 41. And therefore, when the first engaging member 41*c* of the main-assembly-side guide 41 is abutted to the lower end of the second main-assembly-hole portion 40*b*2, the movement of the main-assembly-side guide 41 stops.

Up to this point, the cover member 15 has rotated through only one of the total rotatable angle. The amount of the rotation of the member 15 is limited for the following reason. For example, when the cartridge B is pressed into the image-forming-operation position by moving the main-assembly-side guide 41 by closing the member 15 to its full-close position, the operator, as shown in FIG. 8, pushes the cartridge B in the moving direction of the main-assembly-side guide 41 after the cartridge B is inserted. Then, the member 15 is likely to start to close.

In order to avoid this, in this embodiment, the cartridge B is moved by approximately ½ rotation of the total rotatable angle of the cover member 15. Then, even with the operator presses the cartridge B toward the reuse side, there still remains a sufficient gap between the member 15 and the outer casing portion of the main assembly 14 of the apparatus to which the member 15 is contacted in its full-close position.

The resistance applied when the positioning portion 18*a* of the cartridge B rides over the main-assembly-side-regulating portion 44*b*, gives to the operator the feeling of a click, which is indicative of mounting of the cartridge B in place (image forming operation position) in the process of the closing operation of the member 15. By doing so, the operator can be notified of the event of the mounting of the cartridge B at the correct position.

Figure 12:
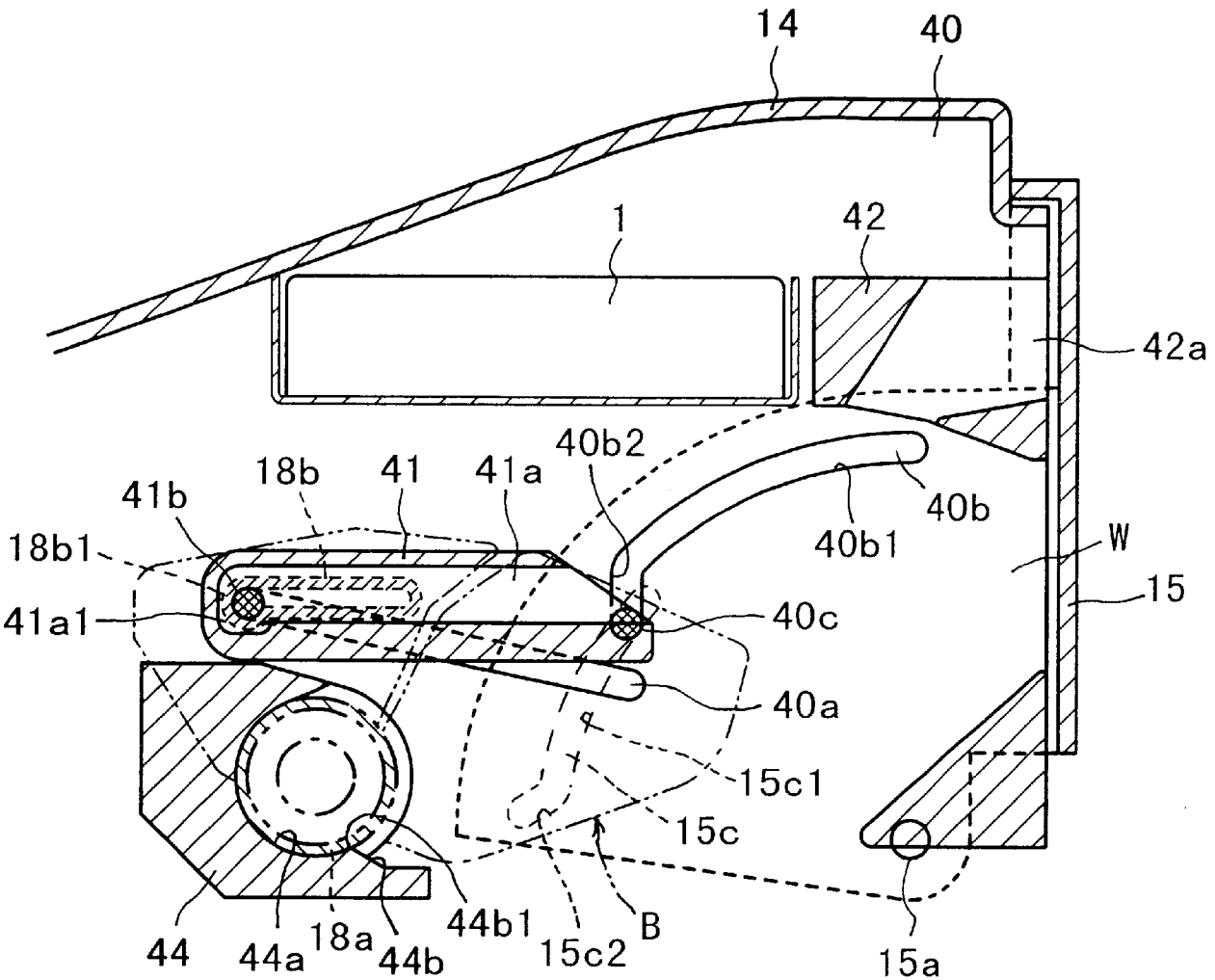
FIG. 12 is an illustration of an operation of the process cartridge mounting-and-demounting mechanism shown in FIG. 3.

As described in the foregoing, when the movement of the main-assembly-side guide 41 is completed, the first engaging member 41*c* is moved into the first plate-hole portion 15*c*1 (FIG. 12). The first plate-hole portion 15*c*1, as described in the foregoing, is arcuate about the rotation shaft 15*a* of the member 15, and the width (the inner diameter along the short side) is slightly larger than the outer diameter of the first engaging member 41*c*. Therefore, when the member 15 is further closed after the completion of the movement of the main-assembly-side guide 41, the first engaging member 41*c* moves along the first plate-hole portion 15*c*1. By doing so, the member 15 continues to rotate without contacting the main-assembly-side guide 41 or to the cartridge B, and as shown in FIG. 12, it completely closes the opening W (full-close position).

When the member 15 is completely closed in this manner, image-formation instructions are produced in a controller (unshown) of the main assembly 14 of the apparatus. Then, the main motor (unshown) is driven, and the photosensitive drum 7 is driven through drive transmitting means (unshown). Then, a rotation stopper 20 provided at the front end of the cartridge B abuts the supporting portion 19 for the rotation stopper provided in the main assembly 14 of the apparatus (FIG. 1). In this case, the cartridge B is positioned in the main assembly 14 of apparatus by the rotation stopper 20 and the positioning portion 18*a* supported by the positioning portion 44*a* of the main assembly. The guide 18*b* is provided such that it floats in the guide groove 14*a* of the main-assembly-side guide 41. That is, the guide 18*b* is out of contact with the walls constituting the guide groove 14*a*.

Figure 13:
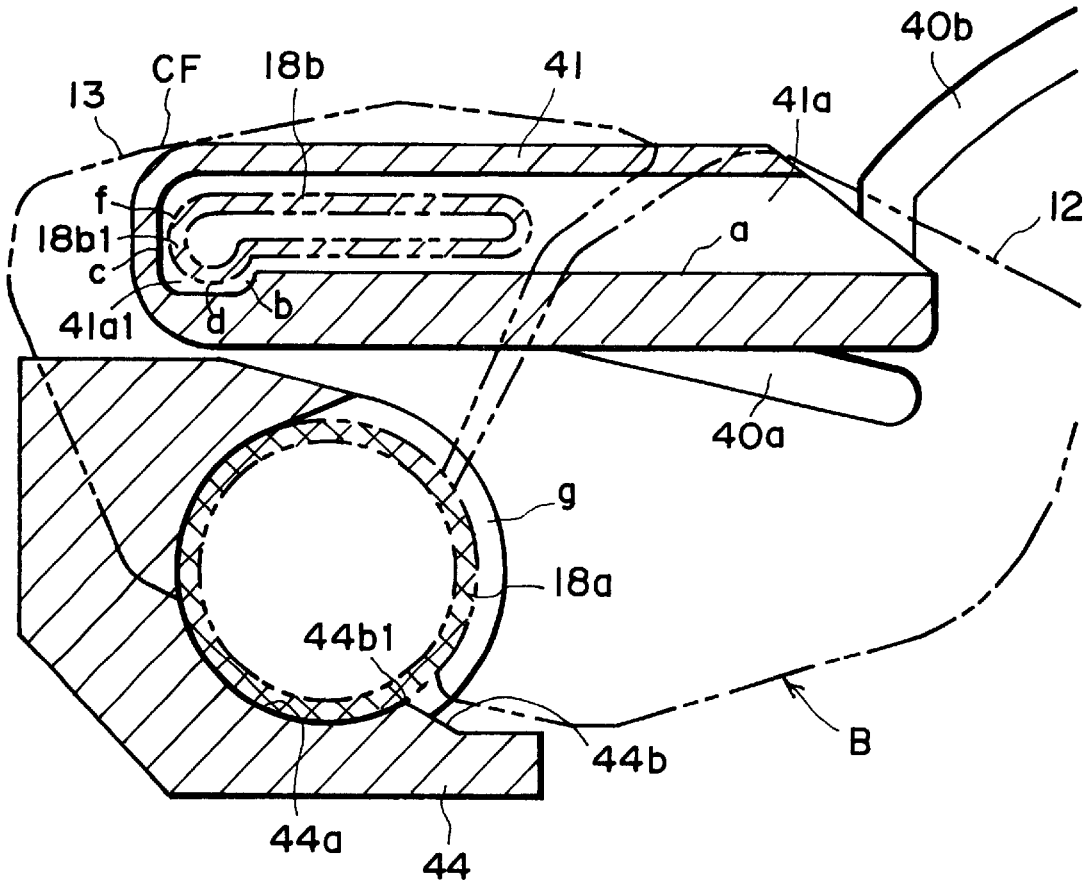
FIG. 13 illustrates a floating right side cartridge guide of the process cartridge away from the main-assembly-side guide when the process cartridge is mounted to the main assembly of the image forming apparatus.
Figure 14:
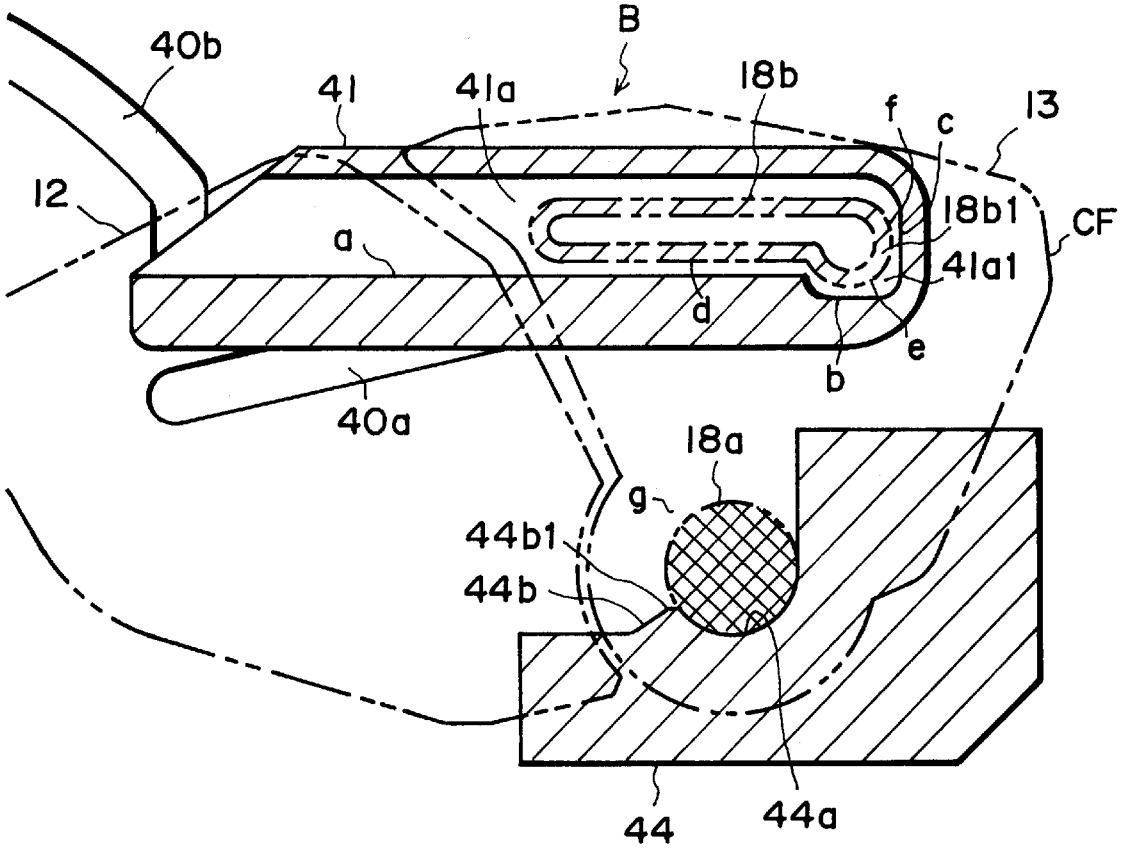
FIG. 14 illustrates a floating left side cartridge guide of the process cartridge away from the main-assembly-side guide when the process cartridge is mounted to the main assembly of the image forming apparatus.

FIG. 13 and FIG. 14 show the state in which the right and left side cartridge guides 18*b* of the cartridge B are floating from the main-assembly-side guide 41 (separated state) when the cartridge B is mounted to the main assembly 14 of the apparatus.

The reason why the positioning portions 18*a* of the cartridge B are supported by the positioning portions 44*a*, is that cartridge B is desirably positioned in the main assembly 14 of the apparatus with high precision in order to provide high-quality and high precision images. The position of the main-assembly-side guide 41 in the main assembly 14 of the apparatus is not assured, and therefore, it is not desirable to use the main-assembly-side guide 41 to correctly position the cartridge B.

A description will be provided as to removal of the cartridge B from the main-assembly-side guide 41 by opening the member 15. The operations are opposite from the foregoing operation.

When the opening and closing member 15 is opened from the closed position shown in FIG. 12, the first engaging member 41*c* travels in the first plate-hole portion 15*c*1. With this, in the first half of the opening action of the member 15, what happens is only an opening operation of the member 15. With further opening of the member 15, the engaging member 41*c* is lifted toward the first main-assembly-hole portion 40*b*1 by the second plate-hole portion 15*c*2 and the second main-assembly-hole portion 40*b*2 in the order of FIG. 11 and FIG. 10. By this time, the cartridge guide 18*b* abuts the guide groove 41*a*, by which the positioning portion 18*a* starts to separate from the positioning portion 44*a*. With further opening of the member 15, the first engaging member 41*c* is moved toward the opening W for the mounting-and-demounting of the cartridge by the front end of the first plate-hole portion 15*c*1 and the first main-assembly-hole portion 40*b*1. With this, the second engaging member 41*b* moves in the first guiding rail 40*a* to the position where the operator can grasp the cartridge B. As shown in FIG. 8, when the member 15 is completely open, the guide groove 41*a* becomes continuous with the guide groove 42*a* (first position). Then, the cartridge B can be taken out by the operator from the opening W.

At this time, the first engaging member 41*c* is placed at the front end of the first plate-hole portion 15*c*1, so that member 15 is prevented from opening further.

In the process cartridge mounting-and-demounting mechanism in this embodiment, the first and second engaging members 41*c*, 41*b* are moved on the guiding rails 40*a*, 40*b* by the closing operation of the member 15 from the full-open position. In the first half of the closing operation of the member 15, the cartridge B is moved from the first position where the cartridge B is mountable to the second position where the cartridge B can be subjected to the image forming operation. In the latter half of the closing operation of the member 15, the engaging member 41*b* of the main assembly side guide 41 is slid in the cam groove 15*c* to permit a closing operation to the full-close position of the opening and closing member 15. By the opening operation of the member 15 from the full-close position, the one engaging member 41*b* of the main assembly side guide 41 is slid in the cam groove 15*c* of the member 15, by which the member 15 can be opened to the half of the opening stroke. The two engaging members 41*b*, 41*c* of the main-assembly-side guide 41 are slid on the guiding rails 40*a*, 40*b* in the latter half of the opening operation of the member 15, and the main-assembly-side guide 41 is moved from the second position to the first position.

By doing so, the cartridge B can be moved in interrelation with the opening and closing operation of the opening and closing member 15. Therefore, even if the cartridge B is to be placed deep in the main assembly 14 of the apparatus, the mounting-and-demounting operation of the cartridge B is easy. The movement of the cartridge B can be carried out in the first half of the opening operation of the member 15 and in the latter half of the closing operation, and the mounting-and-demounting of the cartridge B can be carried out in the first half of the closing operation of the member 15 and in the latter half of the opening operation. Therefore, even if the cartridge B is to be disposed deep into the main assembly 14 of apparatus, there is no need to provide the main assembly 14 of the apparatus with a space for permitting the operator's hand to enter easily when the cartridge B is mounted or demounted. Therefore, usability can be maintained and improved without increasing the size of the main assembly 14 of the apparatus. In addition, since that cartridge B can be placed deep in the main assembly 14, the latitude of the unit disposition in the electrophotographic image forming apparatus A is improved.

Furthermore, the main-assembly-side guide 41 is moved between the optical system 1 and the feeding means 3, and it takes a pose in which it is inclined downward (crossing with the feeding direction of the recording material 2 by the feeding means 3) in the mounting direction X of the cartridge B to the guide groove 41*a* (first pose), at the first position, and takes a pose which is different from the pose of the first position.

Therefore, the cartridge B can be moved between the optical system 1 and the feeding means 3. When the cartridge B is mounted to the main-assembly-side guide 41 placed at the first position, the cartridge B is brought into abutment to the rear side of the guide groove 41*a* by the weight due to the downward inclination of the main-assembly-side guide 41. While the main-assembly-side guide 41 is moving to the second position, the process cartridge B is at rest at the position.

When the main-assembly-side guide 41 is at the first position and during movement of the main-assembly-side guide 41 from the first position to the second position, the guide 18*b* of the cartridge B is retained by the guide groove 41*a*. When the main-assembly-side guide 41 reaches the second position, the cartridge B is positioned correctly and supported by the positioning portion 44*a* of the main assembly at the operation-forming-operation position by the positioning portion 18*a*. Therefore, the cartridge B can be placed at the predetermined position with precision, for the image forming operation.

The sector plate 15*b* having the cam groove 15*c* for moving the main-assembly-side guide 41 is integral with the member 15. Accordingly, the increase in the number of parts required by the cartridge mounting-and-demounting mechanism can be suppressed, thus suppressing the increase of the number of assembling steps, by which the cost increase is minimized.

The cartridge B is provided with the cartridge guide 18*b* supported by the main-assembly-side guide 41 and the positioning portion 18*a* supported by the positioning portion 44*a* of the main assembly, which are separate from each other. By this, the first and second main-assembly-side guides 41 (left and right) and the positioning portions 44*a* can be disposed at the same position in the longitudinal direction of the cartridge B. Therefore, it is not necessary to increase the length of the cartridge B.

The positioning guide 44 is provided with the positioning portion 44*a* engageable with the positioning portion 18*a* of the cartridge B and the main-assembly-side regulating portion 44*b*, which is disposed upstream of the positioning portion 44*a* with respect to the moving direction of the main-assembly-side guide 41 from the first position toward the second position and across the movement locus of the positioning portion 18*a* to the positioning portion 44. Therefore, the positioning portion 18*a* which has been moved by the movement of the main-assembly-side guide 41 from the first position to the second position, abuts the main-assembly-side-regulating portion 44*b*, and rides over the main-assembly-side-regulating portion 44*b* to guide the positioning portion 18*a* to the positioning portion 44*a*. At this position, the process cartridge B can be handed from the main-assembly-side guide 41 to the positioning portion 44*a* of the positioning guide 44 in the main assembly.

The front guide 42 is disposed upstream of the main-assembly-side guide 41 in the mounting direction X, and therefore, the main-assembly-side guide 41 placed at the first position can be prevented from being moved by the cartridge B.

Second Embodiment

In the foregoing first embodiment, the mounting-and-demounting mechanism has a sector plate 15*b* integrally mounted to the opening and closing member 15, the sector plate 15*b* being provided with a cam groove 15*c* for guiding the main-assembly-side guide 41. A description will be provided as to a cartridge mounting-and-demounting mechanism in which a cam plate 50 having a cam groove 50*a* for guiding the main-assembly-side guide 41 and the opening and closing member 15 are provided separately, so that latitude in the design is improved. The same reference numerals that are assigned to the elements of this embodiment hav the corresponding functions in the foregoing embodiment.

Figure 15:
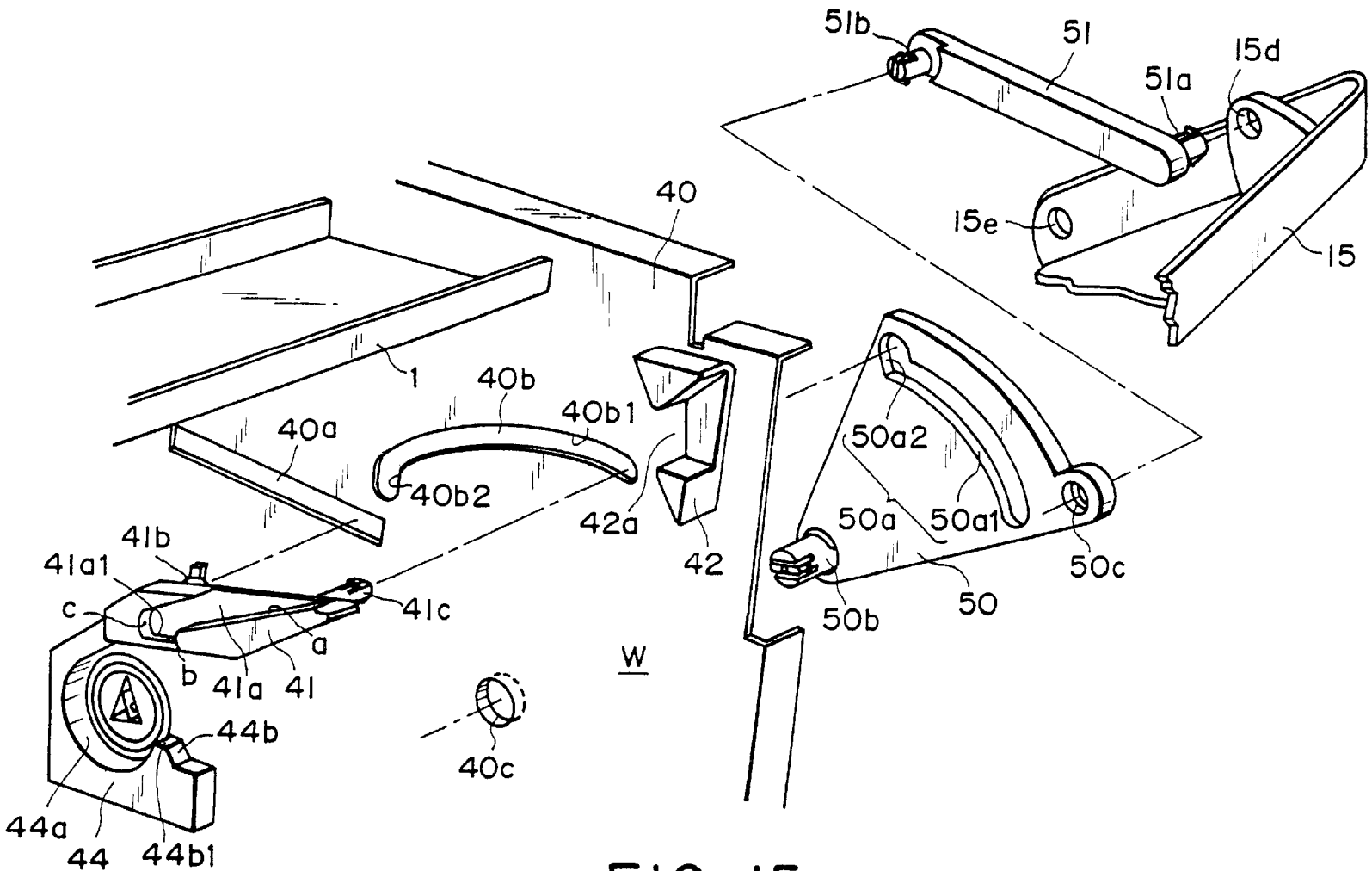
FIG. 15 is an exploded perspective view of a process cartridge mounting-and-demounting mechanism according to another embodiment of the present invention.

FIG. 15 is an exploded perspective view of the cartridge mounting-and-demounting mechanism in this embodiment. The cam plate 50 is provided with a cam groove 50*a* including an arcuate groove hole 50*a*1 as a first plate-hole portion similar to the first embodiment and a line groove 50*a*2 as a second plate-hole portion, a rotation shaft 50*b* which is rotatably engageable with the engaging hole 40*c* of the main-assembly fixed member 40 and which functions as a center of rotation of the cam plate 50, and a connecting hole 50*c* in the axis direction of the rotation shaft 50*b*. The opening and closing member 15 is:provided with a supporting hole 15*e* for rotatable engagement with a rotation shaft (unshown) at a position away from the engaging hole 40*c* of the main-assembly fixed member 40, and is provided with a connecting hole 15*d* in the inner surface extending in the longitudinal direction of the cartridge B. The supporting hole 15*e* and the connecting hole 15*d* have axes extending in the axis direction of the rotation shaft 50*b*. A cam plate 50 is connected to the member 15 through a connection plate 51 (connecting member). The connection plate 51 is disposed in the main-assembly fixed member 40 at a position opposite from the guiding rails 40*a*, 40*b*. At the opposite ends thereof, connecting shafts 51*a*, 51*b* are provided. A connecting shaft 51*a* at one end is rotatably engaged in the connecting hole 15*d* of the member 15. The connecting shaft 51*b* at the other end is rotatably engaged in the connecting hole 50*c* of the cam plate 50.

The cartridge mounting-and-demounting mechanism of this embodiment constitutes a slider crank mechanism by the main-assembly-side guide 41 and the cam plate 50, and constitutes a quadric crank mechanism by the cam plate 50, the member 15, the connection plate 51, and the main assembly 14 of the apparatus. Therefore, the cam plate 50 receives the opening and closing actions of the member 15 through the connection plate 51, and rotates in interrelation with the opening and closing operation of the member 15 about the rotation shaft 50*b*. By the rotating operation of the cam plate 50 interrelated with the opening and closing operation of the member 15, the main-assembly-side guide 41 moves in the same manner as the first embodiment.

In the cartridge mounting-and-demounting mechanism of this embodiment, the two engaging members 41*b*, 41*c* are slid on the guiding rails 40*a*, 40*b* by the closing operation of the member 15 from the full-open position. In the first half of the closing operation of the member 15, the cartridge B is moved from the first position where the cartridge B is mountable to the second position where the cartridge B can be subjected to the image forming operation. In the latter half of the closing operation of the member 15, one engaging member 41*b* is slid in the cam groove 50*a* to permit the closing action to the full-close position of the member 15. By the opening operation of the member 15 from the full-close position, one engaging member 41*b* is slid in the cam groove 50*a* to permit the opening operation of the member 15 to the first half of the opening operation. In the latter half of the opening operation of the member 15, two engaging members 41*b*, 41*c* are slid on the guiding rails 40*a*, 40*b* to move the main-assembly-side guide 41 from the second position to the first position.

In this embodiment, the same advantageous effects as the first embodiment can be provided. When the outer casing unit having the member 15 is changed to meet particular desires in the world for example, or when the outer casing is changed by a model change, and the center of rotation position of the member 15 is changed, the cartridge mounting-and-demounting mechanism in the main assembly 14 of the apparatus can be used as it is if the inter-axis distance of the connection plate 51 and the position of the connecting hole 15*d* of the member 15 is changed.

Third Embodiment

In the first and second embodiments, a cartridge mounting-and-demounting mechanism is provided in which the member 15 or the cam plate 50 constitutes a crank, and a slider crank mechanism with the main assembly side guide 41 is the slider. In the first and second embodiments, the main-assembly-side guide 41 is directly moved by the rotation of the member 15 or the cam plate 50 as the crank. Therefore, the loss of the force is small, and the structure is stable.

The cartridge mounting-and-demounting mechanism of this embodiment is advantageous in the latitude of the movement locus of the main-assembly-side guide 41 and the movement locus of the cartridge B, which is moved by the main-assembly-side guide 41.

The same reference numerals as the first embodiment are assigned to the element having the corresponding functions as with the first embodiment.

Figure 16:
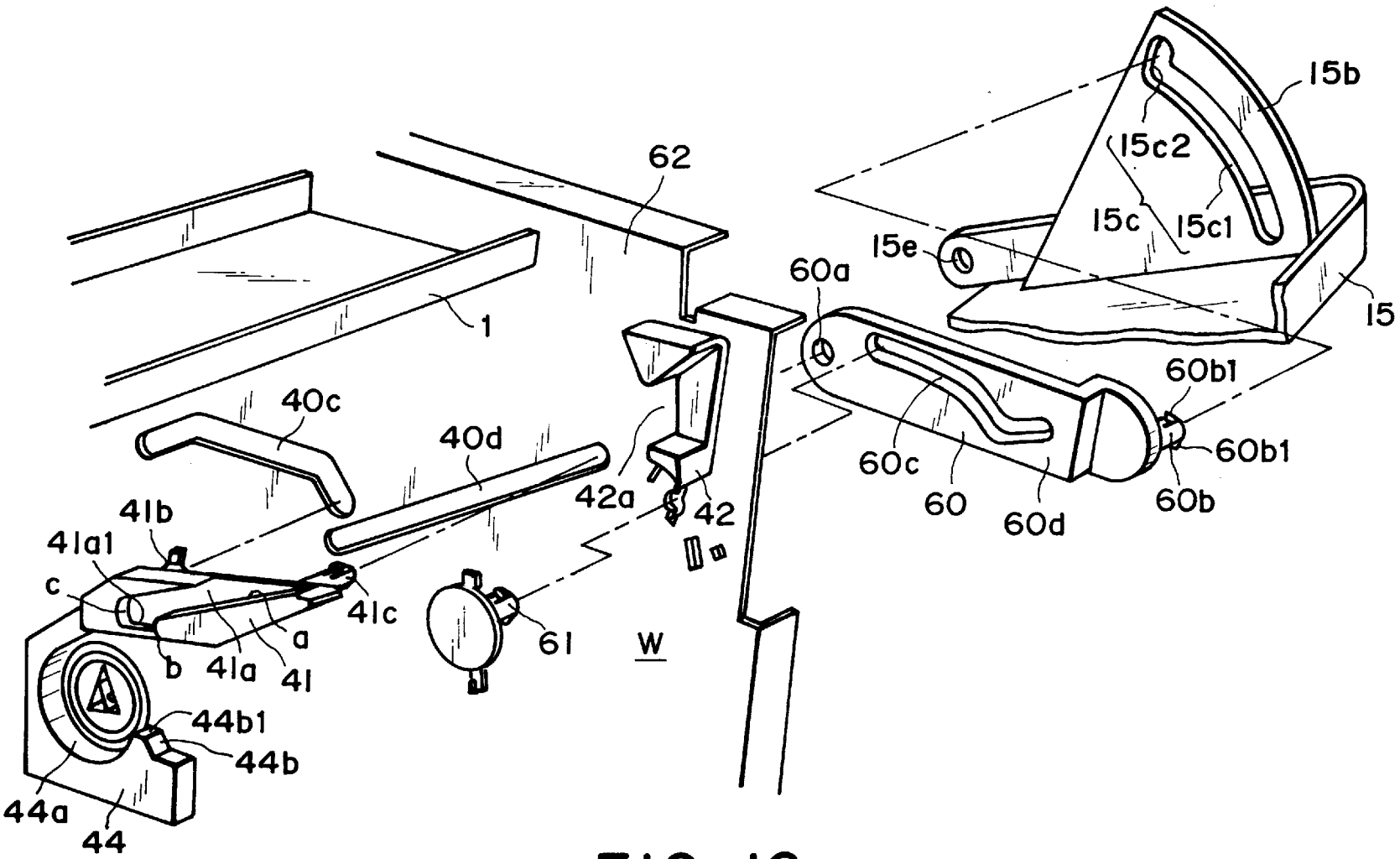
FIG. 16 is an exploded perspective view of a process cartridge mounting-and-demounting mechanism according to a further embodiment of the present invention.

FIG. 16 is an exploded perspective view of a cartridge mounting-and-demounting mechanism according to this embodiment. In FIG. 16, the opening and closing member 15 has a sector plate 15*b* provided with a cam groove 15*c* which includes a first plate-hole portion 15*c*1 extending about the rotation shaft 15*a* similarly to the first embodiment and a second plate-hole portion 15*c*2, which is continuous from the first plate-hole portion 15*c*1 and which is inclined downward toward the closing direction relative to the radial direction of the member 15. The member 15 is provided with a supporting hole 15*e* for supporting it rotatably on the rotation shaft 15*a* (FIG. 17), at the front end adjacent the center of the sector-shape of the sector plate 15*b*. The main-assembly-side guide 41 has the same shape as the first and second embodiments.

It is provided with a guide groove 41*a* in which the guide 18*b* of the cartridge B is guided in the opening W side surface. The side opposite from the guide groove 41*a* is provided with first and second engaging members 41*c*, 41*b*. An inner plate 62 of the main assembly 14 of the apparatus is provided with first and second guiding rails 40*c*, 40*d* as holding means for determining a movement locus of the main-assembly-side guide 41 by engagement with the engaging members 41*b*, 41*c* of the main-assembly-side guide 41. The guiding rails 40*c*, 40*d* can be designed such that the cartridge B guided by the main-assembly-side guide 41 can avoid the inner parts in the main assembly 14 of the apparatus.

At the side of the inner plate 62 opposite from the guiding rails 40*c*, 40*d*, there is provided a connection cam plate 60 as a cam member connecting the first engaging member 41*c* and the cam groove 15*c* of the member 15. A cam shaft 61, which is a shaft for holding the pose of the connection cam plate 60, is fixed to the inner plate 62. The cam shaft 61 is penetrated through the inner plate 62 and is projected toward the connection cam plate 60. The connection cam plate 60 is provided at one end of the main assembly 60*d* of the plate with an engaging hole 60*a* for rotatably supporting a first engaging member 41*c*, and at the other end with a boss 60*b* as a projected guide for slidable engagement with the cam groove 15*c* of the member 15. At the front end of the boss 60*b*, a snap fitting claw 60*b*1 is provided for a retainer. The connection cam plate 60 rotatably supports the first engaging member 41*c* of the main-assembly-side guide 41 in the engaging hole 60*a*, and the boss 60*b* is in slidable engagement with the cam groove 15*c* of the member 15.

A cam groove 60*c* is formed between the engaging hole 60*a* and the boss 60*b* in the main assembly 60*d* of the plate of the connection cam plate 60. The cam groove 60*c* is slidably engaged with the cam shaft 61 fixed to the inner plate 62.

Referring to FIGS. 17 to 21, a description will be provided as to the opening and closing operation of the member 15 and the movement of the main-assembly-side guide 41 in the cartridge mounting-and-demounting mechanism of this embodiment. The same thing as with the first embodiment applies to this embodiment as to the mounting of the cartridge B to the main-assembly-side guide 41, the engagement between the positioning portion 44*a* of the main assembly and the positioning boss 18*b* of the cartridge B, and the subsequent figure supporting of the cartridge B in the main assembly 14 of the apparatus. Therefore, a description thereof is omitted for simplicity.

Figure 17:
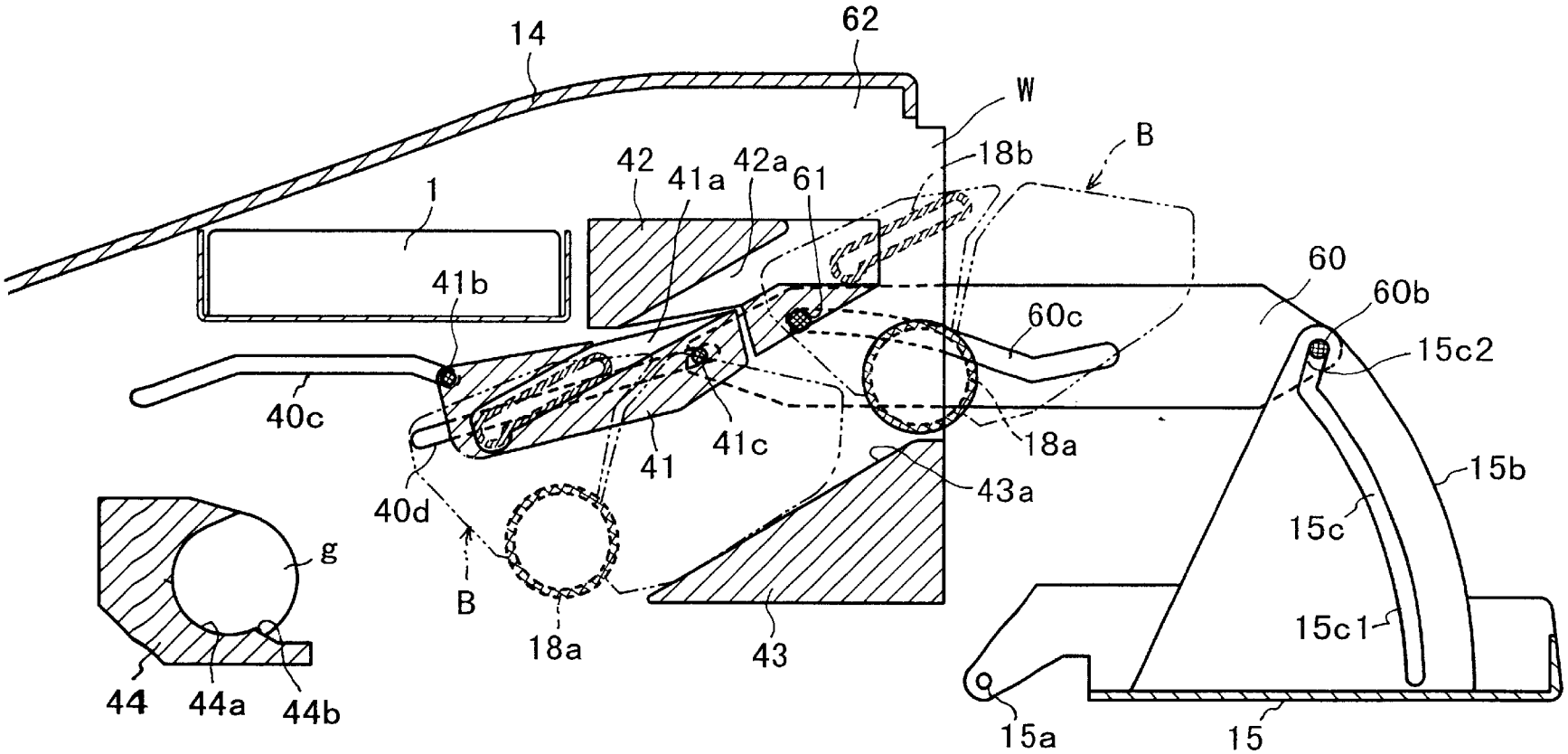
FIG. 17 is an illustration of an operation of a process cartridge mounting-and-demounting mechanism shown in FIG. 13.

FIG. 17 shows the state in which the member 15 is completely open (full-open position). Similarly to first embodiment, the cartridge B is inserted into the opening W. At this time, the first engaging member 41*c* abuts to the member 15 side end of the second guiding rail 40*d*. Between the second engaging member 41*b* and opening and closing member side end of the first guiding rail 40*c*, a small clearance remains. In this case, one end side of the cam plate 60 is supported by the first engaging member 41*c* and the engaging hole 60*a*. At the other end side of the connection cam plate 60, the boss 60*b* abuts to the front end of the first plate-hole portion 15*c*1.

Figure 18:
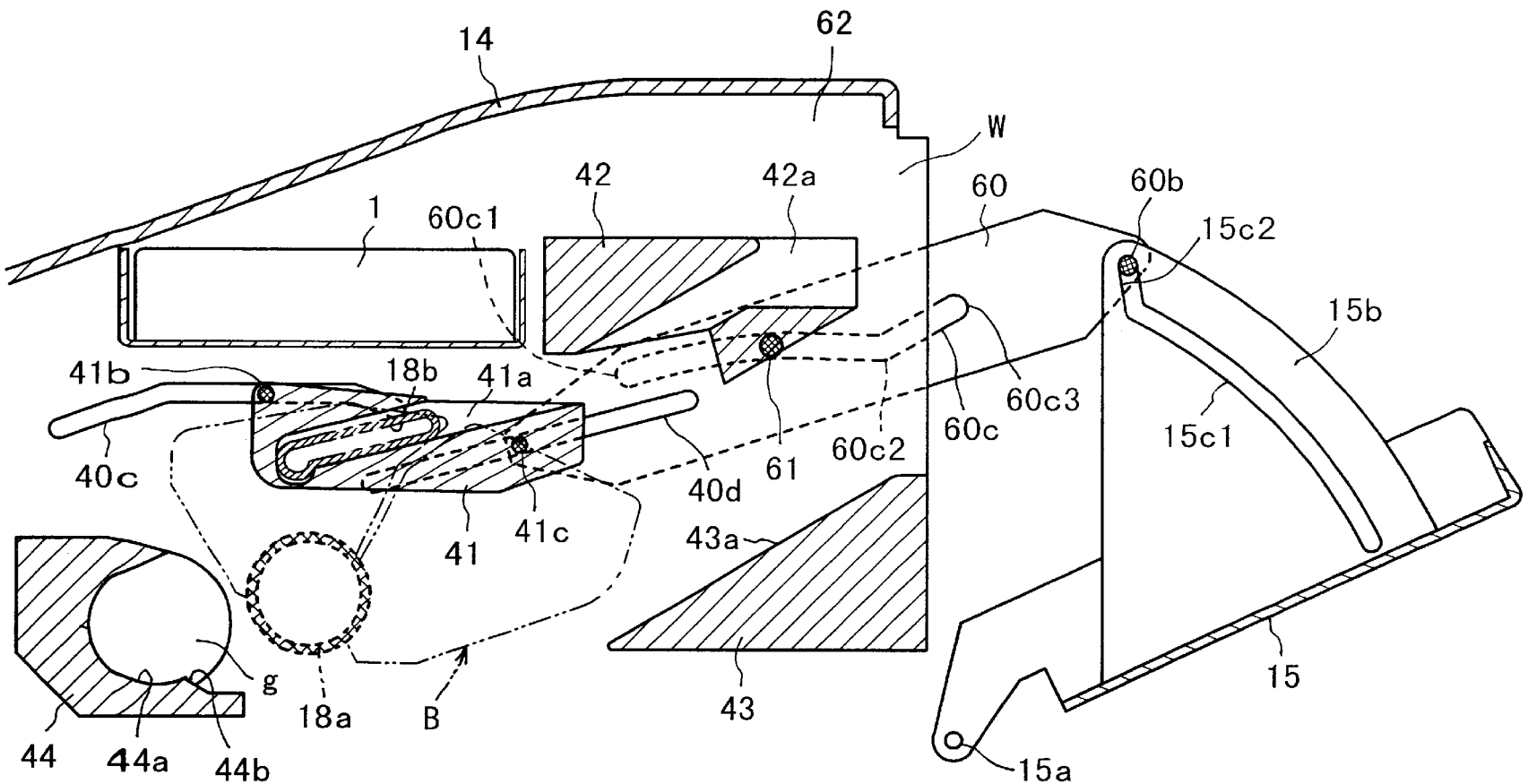
FIG. 18 is an illustration of an operation of the process cartridge mounting-and-demounting mechanism shown in FIG. 13.
Figure 19:
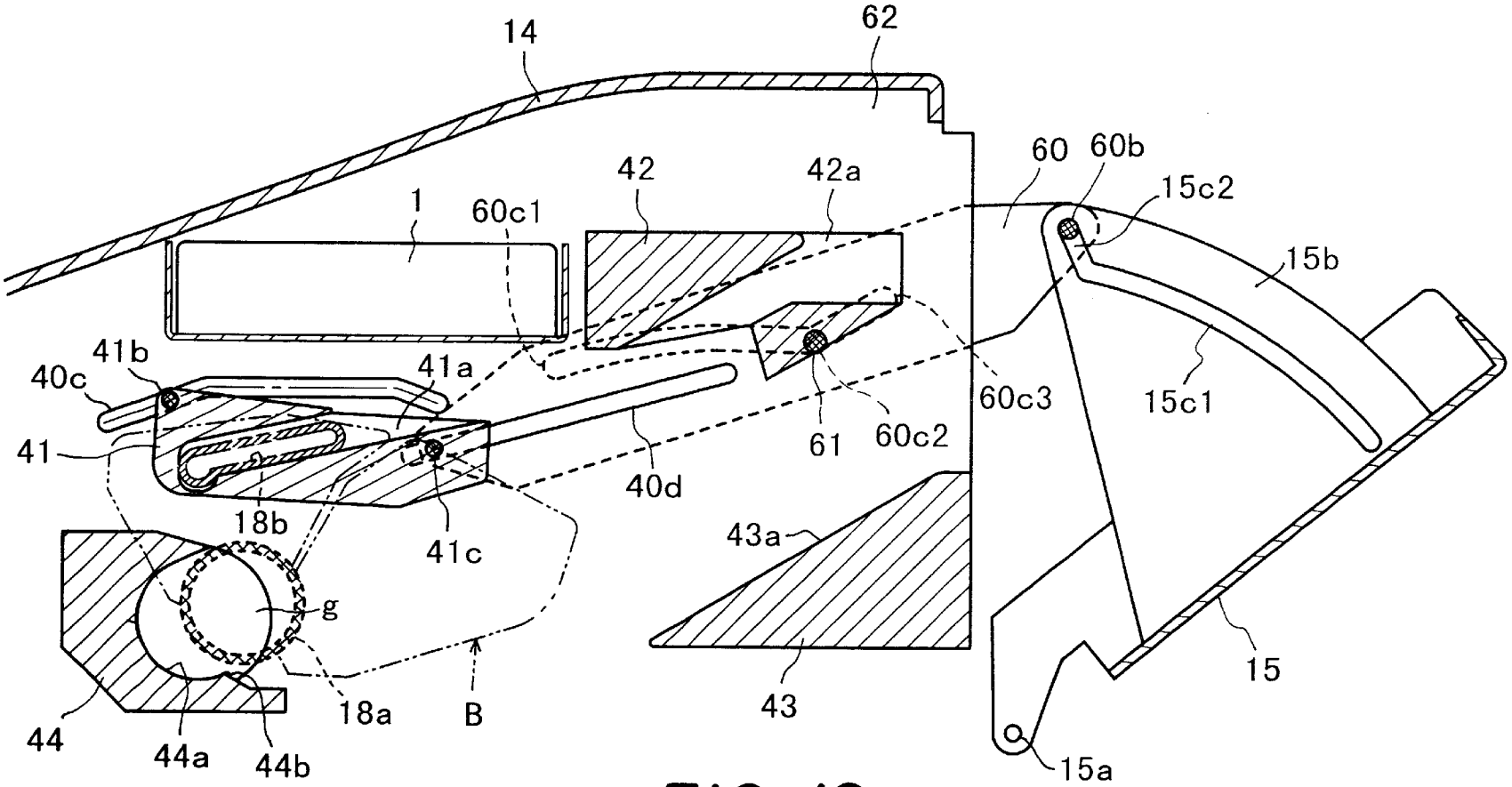
FIG. 19 is an illustration of an operation of the process cartridge mounting-and-demounting mechanism shown in FIG. 13.

When the member 15 is closed, as shown in FIGS. 18 and 19, the cam plate 60 is moved toward the rear side of the main assembly 14 of the apparatus while keeping the abutment between the boss 60*b* and the end of the second plate-hole portion 15*c*2. The portion of the cam groove 60*c* from one end 60*c*1 to a bent portion 60*c*2 corresponds to the track of the cam shaft 61 of the inner plate 62 during the movement of the connection cam plate 60 with the connecting relation maintained.

Figure 20:
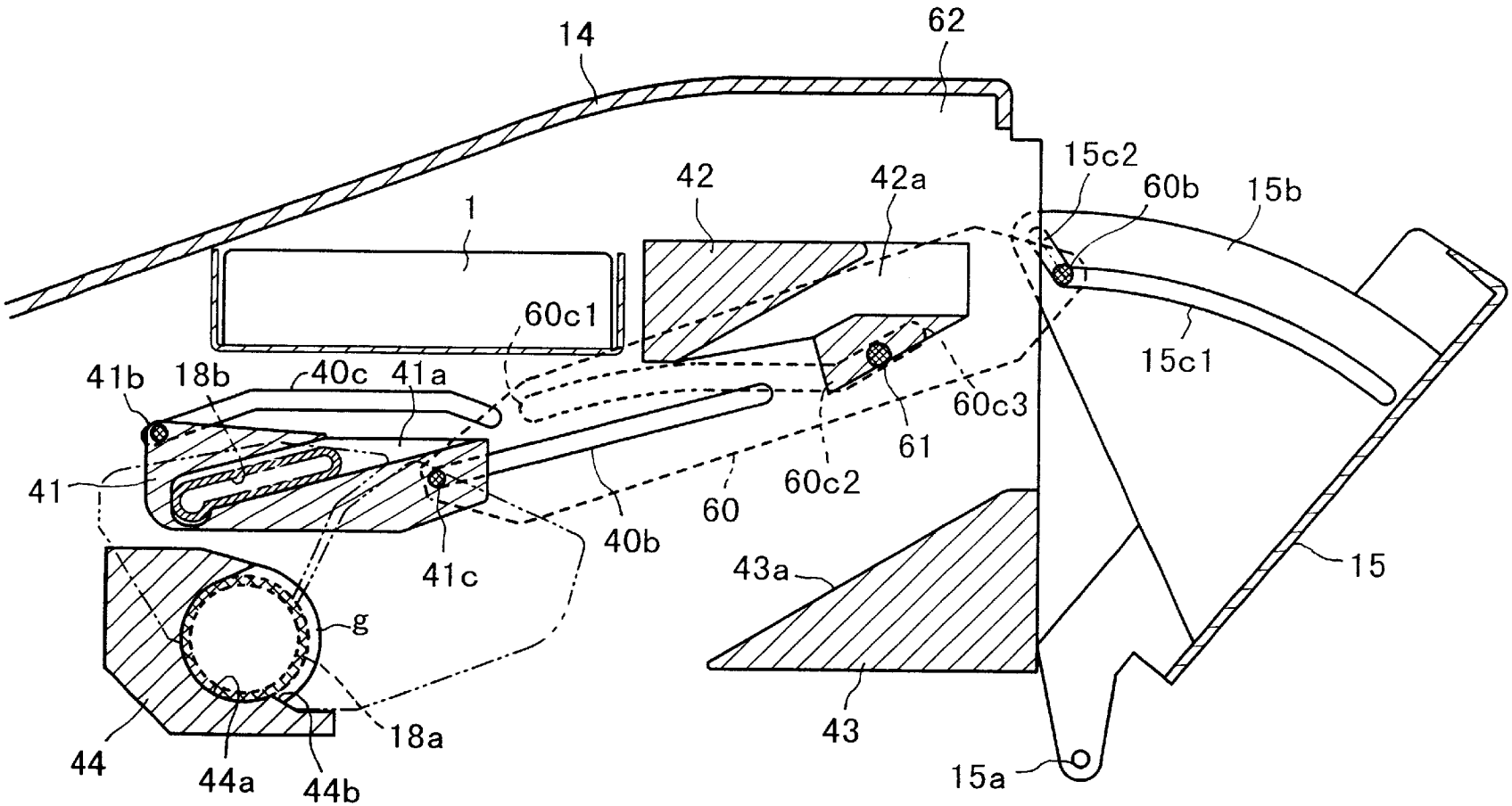
FIG. 20 is an illustration of an operation of the process cartridge mounting-and-demounting mechanism shown in FIG. 13.
Figure 21:
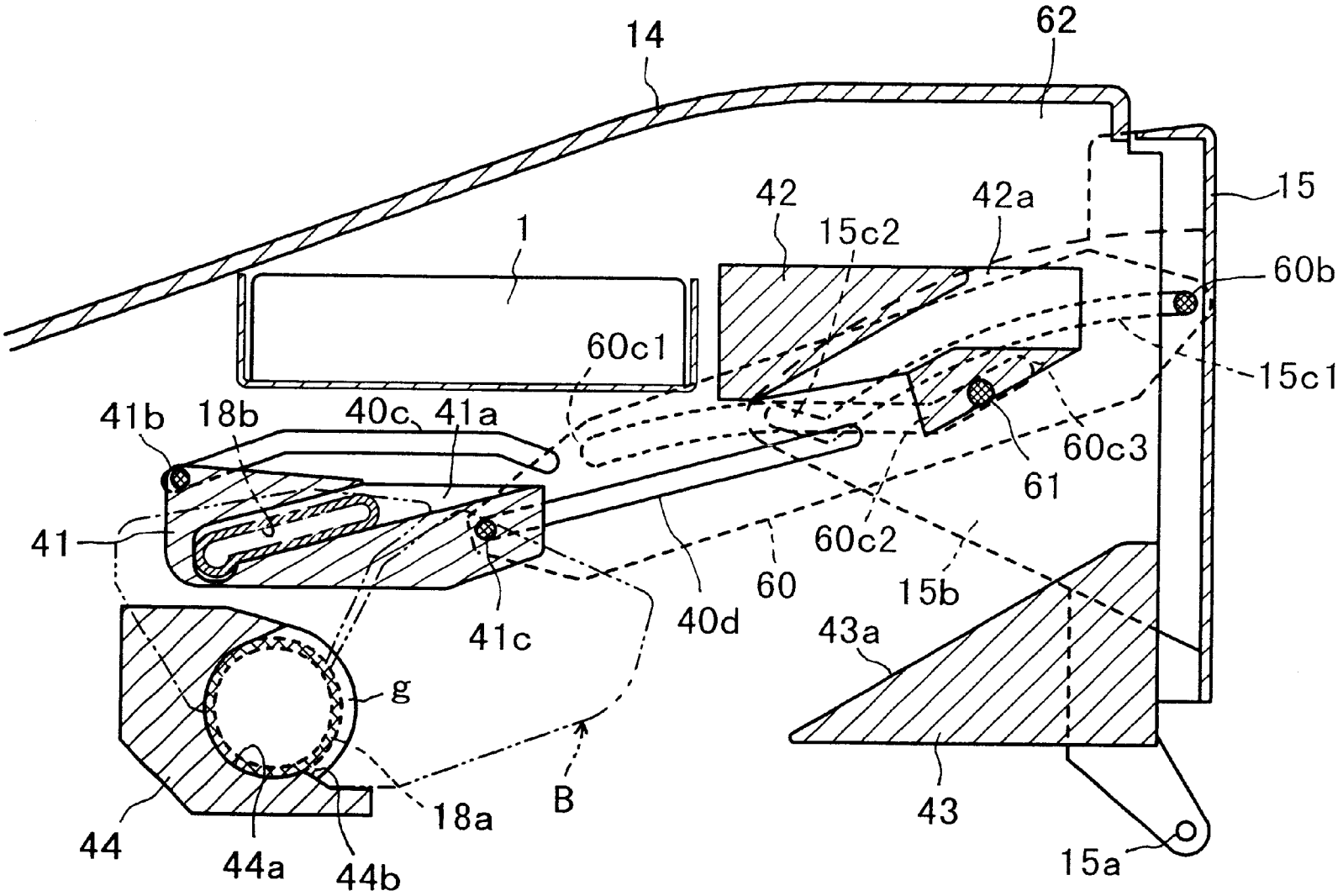
FIG. 21 is an illustration of an operation of the process cartridge mounting-and-demounting mechanism shown in FIG. 13.

When the member 15 is further closed from the position shown in FIG. 19 to the position shown in FIG. 20, the movement of the main-assembly-side guide 41 approaches the final stage. At this time, the abutment between the cam groove 60*c* and the cam shaft 61 of the inner plate 62 changes from the bent portion 60*c*2 to the other end 60*c*3 of the cam groove 60*c*. When the cam shaft 61 moves between the bent portion 60*c*2 and the other end 60*c*3, the connection cam plate 60 rotates above the engaging hole 60*a* relative to the first engaging member 41*c*. The boss 60*b* provided at the other end side of the connection cam plate 60 is moved from the front end of the second plate-hole portion 15*c*2 to the connection side (intersection side) between the second plate hole portion 15*c*2 and the arcuate groove hole 15*c*1. As shown in FIG. 20, when the boss 60*b* is moved to the arcuate hole 15*c*1, the main-assembly-side guide 41 completes its motion on the guiding rails 40*c*, 40*d*. By this, the cartridge B becomes supported by the positioning guide 44. At this time, the opening and closing member 15 is at ½ the full stroke of the closing operation similarly to the first and second embodiments. When the member 15 is further closed, the boss 60*b* slides in the first plate-hole portion 15*c*1. Therefore, the member 15 can be completely closed to the full-close position as shown in FIG. 21 without an external force imparted to the connection cam plate 60.

A description will be provided as to a pulling operation to move the cartridge B to the position where the cartridge B can be easily taken out from the closed position of the member 15.

The operations are opposite from the process described in the foregoing. When the member 15 is between the closed position (FIG. 21) and the position shown in FIG. 20, the connection cam plate 60, the main-assembly-side guide 41, and the cartridge B are not moved, and only the member 15 is opened. This is because the first plate-hole portion 15*c*1 is circular about the center of rotation of the member 15 with the radius equal to the distance of a line connecting the boss 60*b* and the rotation shaft 15*a* of the member 15. Until the position shown in FIG. 20, with the opening of the member 15, the boss 60*b* contacts the first plate-hole portion 15*c*1 and then to the second plate-hole portion 15*c*2, and starts movement of the main-assembly-side guide 41 toward the opening W. Then, the cartridge B carried on the main-assembly-side guide 41 is disengaged from the positioning guide 44 and starts to move with the main-assembly-side guide 41. The abutment between the boss 60*b* and the cam groove 15*c* changes toward the front end side of the second plate-hole portion 15*c*2 (FIG. 20 to FIG. 19). Thereafter, in interrelation with the opening operation of the member 15, the main-assembly-side guide 41 slides on the guiding rails 40*c*, 40*d* (FIG. 18 to FIG. 17). As shown in FIG. 17, when the member 15 is completely opened (full-open position), the cartridge B has been pulled out to such a position that an operator can access it. Subsequently, the operator pulls it along the guide groove 41*a* of the main-assembly-side guide 41, by which the cartridge B is taken out.

Thus, in the cartridge mounting-and-demounting mechanism of this embodiment, the two engaging members 41*b*, 41*c* of the main-assembly-side guide 41 is slid on the two guiding rails 40*c*, 40*d* by the closing operation from the full-open position of the member 15. In the first half of the closing operation of the member 15, the cartridge B is moved from the first position where the cartridge B is mountable to the second position where the cartridge B can be subjected to the image forming operation. In the latter part of the closing operation of the member 15, the cam shaft 61 slides in the cam groove 60*c*, and the boss 60*b* slides in the cam groove 15*c* to permit the closing action of the member 15 to the full-close position. By the opening operation of the member 15 from the full-close position, the cam shaft 61 slides in the cam groove 60*c*, and the boss 60*b* slides in the cam groove 15*c* of the member 15 to permit the opening action of the member 15 to the first half of the opening action. In the latter half of the opening operation of the member 15, two engaging members 41*b*, 41*c* are slid on the guiding rails 40*a*, 40*b* to move the main-assembly-side guide 41 from the second position to the first position.

Thus, in this embodiment, by using the cartridge mounting-and-demounting mechanism, the same advantageous effects as with first embodiment can be provided, and in addition, the movement of the main-assembly-side guide 41 in interrelation with the opening and closing operation of the member 15 is effected through the connection cam plate 60. Therefore, the movement locus of the main-assembly-side guide 41 and the movement locus of the cartridge B moved by the main-assembly-side guide 41 are not limited, so that the latitude in the design can be improved.

The above-described embodiments can be summarized as follows.

First, the mounting mechanism for the process cartridge is summarized.

There is provided a process-cartridge mounting mechanism for mounting a process cartridge (B) to a mounting position in a main assembly (14) of an electrophotographic image forming apparatus, wherein the cartridge (B) comprises an electrophotographic photosensitive member (7) and process means (at least one of 8, 10 and 11) actable on the photosensitive member (7), the process-cartridge mounting mechanism comprising an openable cover member (15) mounted to the main assembly (14) of the apparatus, the cover member (15) being opened and closed when the cartridge (B) is mounted to or demounted from the main assembly (14) of the apparatus; a first main-assembly-side guide (41) which is provided in the main assembly of the apparatus and which is movable in interrelation with an opening and closing operation of the cover member (15), the first main-assembly-side guide (41) including a first supporting portion (a) and a first urging portion (b); a second main-assembly-side guide (41) which is provided in the main assembly of the apparatus and which is movable in interrelation with an opening and closing operation of the cover member (15), the second main-assembly-side guide (41) including a second supporting portion (a) and a second urging portion (b); a first cartridge guide (18*b*), provided in the cartridge (B) at one longitudinal end of a cartridge frame (CF), for guiding the cartridge (B) toward the mounting position; the first cartridge guide (18*b*) including a first supported portion (d) to be supported on the first supporting portion (a) and a first urged portion (e) to be urged to the first urging portion (b); a second cartridge guide (18*b*), provided in the cartridge (B) at one longitudinal end of a cartridge frame (CF), for guiding the cartridge (B) toward the mounting position, the second cartridge guide (18*b*) including a second supported portion (d) to be supported on the second supporting portion (a) and a second urged portion (e) to be urged to the second urging portion (b); wherein the cartridge (B) is mounted to the mounting position in interrelation with a closing operation of the cover member (15).

As regards the electrophotographic image forming apparatus, there is provided an electrophotographic image forming apparatus for forming an image of a recording material, to which a process cartridge (B) is detachably mountable, the apparatus comprising (a) an openable cover member (15) mounted to the main assembly of the apparatus, the cover member (15) being opened and closed when the cartridge (B) is mounted to or demounted from the main assembly of the apparatus; (b) a first main-assembly-side guide (41) which is provided in the main assembly of the apparatus and which is movable in interrelation with an opening and closing operation of the cover member (15), the first main-assembly-side guide (41) including a first supporting portion (a) and a first urging portion (b); (c) a second main-assembly-side guide (41) which is provided in the main assembly of the apparatus and which is movable in interrelation with an opening and closing operation of the cover member (15), the second main-assembly-side guide (41) including a second supporting portion (a) and a second urging portion (b); (d) mounting means for mounting a process cartridge (B), the process cartridge (B) including: process means (at least one of 8, 10 and 11) actable on the electrophotographic photosensitive member (7); a first cartridge guide (18*b*), provided in the cartridge (B) at one longitudinal end of a cartridge frame (CF), for guiding the cartridge (B) toward the mounting position, the first cartridge guide (18*b*) including a first supported portion (d) to be supported on the first supporting portion (a) and a first urged portion (e) to be urged to the first urging portion (b); a second cartridge guide (18*b*), provided in the cartridge (B) at one longitudinal end of a cartridge frame (CF), for guiding the cartridge (B) toward the mounting position, the second cartridge guide (18*b*) including a second supported portion (d) to be supported on the second supporting portion (a) and a second urged portion (e) to be urged to the second urging portion (b); wherein the cartridge (B) is mounted to the mounting position in interrelation with a closing operation of the cover member (15).

As regards the process cartridge, there is provided a process cartridge (B) detachably mountable to a main assembly of an electrophotographic image forming apparatus for forming an image on a recording material, wherein the image forming apparatus includes an openable cover member (15) mounted to the main assembly of the apparatus, the cover member (15) being opened and closed when the cartridge (B) is mounted to or demounted from the main assembly of the apparatus; a first main-assembly-side guide (41) which is provided in the main assembly of the apparatus and which is movable in interrelation with an opening and closing operation of the cover member (15), the first main-assembly-side guide (41) including a first supporting portion (a) and a first urging portion (b); and a second main-assembly-side guide (41) which is provided in the main assembly of the apparatus and which is movable in interrelation with an opening and closing operation of the cover member (15), said second main-assembly-side guide (41) including a second supporting portion (a) and a second urging portion (b); an electrophotographic photosensitive member (7); process means (at least one of 8, 10 and 11) actable on the photosensitive member (7); a cartridge frame (CF); a first cartridge guide (18*b*), provided in the cartridge (B) at one longitudinal end of a cartridge frame (CF), for guiding the cartridge (B) toward the mounting position, the first cartridge guide (18*b*) including a first supported portion (d) to be supported on the first supporting portion (a) and a first urged portion (e) to be urged to the first urging portion (b); a second cartridge guide (18*b*), provided in the cartridge (B) at one longitudinal end of a cartridge frame (CF), for guiding the cartridge (B) toward the mounting position, the second cartridge guide (18*b*) including a second supported portion (d) to be supported on the second supporting portion (a) and a second urged portion (e) to be urged to the second urging portion (b); wherein the cartridge (B) is mounted to the mounting position in interrelation with a closing operation of the cover member (15).

By moving the second cartridge guide 18*b* and by urging the first urged portion e with the first urging portion b, and by urging the second urged portion e with the second urging portion b, the cartridge B is mounted to the mounting position in interrelation with the closing operation of the member 15.

According to another aspect, the first cartridge guide (18*b*) includes an abutting portion (f) for abutting a guide regulating portion (c) provided in the first supporting portion (a), the abutting portion (f) being provided at a front end of the first cartridge guide (18*b*) in a mounting direction of the cartridge (B); and the first cartridge guide (18*b*) includes an abutting portion (f) abutting a guide regulating portion (c) provided in the first supporting portion (a), the abutting portion (f) being provided at a front end of the first cartridge guide (18*b*) in a mounting direction of the cartridge (B).

According to a further aspect, the invention relates to a process cartridge mounting mechanism according to the cartridge noted above, wherein the first urged portion (e) and the first supported portion (d) are integrally molded, and the second urged portion (e) and the second supported portion (d) are integrally molded.

According to a further aspect, the first cartridge guide (18*b*) is projected outwardly from a cartridge frame (CF) portion provided at one longitudinal end of the cartridge frame (CF), and the first cartridge guide (18*b*) is integrally molded with the cartridge frame (CF); and the second cartridge guide (18*b*) is projected outwardly from a cartridge frame (CF) portion provided at the other longitudinal end of the cartridge frame (CF), and the second cartridge guide (18*b*) is integrally molded with the cartridge frame (CF).

According to a further aspect, one longitudinal end of the cartridge frame (CF) is provided with a first positioning portion (18*a*) for positioning the cartridge (B) to the mounting position, and the other longitudinal end of the cartridge frame (CF) is provided with a second positioning portion (18*a*) for positioning the cartridge (B) to the mounting position, wherein the first positioning portion (18*a*) and the second positioning portion (18*a*) are engaged with a main-assembly-side-positioning portion (44*a*, 44*a*) provided in the main assembly.

According to a further aspect, the photosensitive member (7) is in the form of a drum, and wherein the first positioning portion (18*a*) and the second positioning portion (18*a*) are coaxial with the photosensitive drum.

According to a further aspect, the first cartridge guide (18*b*) and the second cartridge guide (18*b*) are so disposed so that first cartridge guide (18*b*) is above the first positioning portion (18*a*) in a vertical direction, and the second cartridge guide (18*b*) is above the second positioning portion (18*a*), when the cartridge (B) is mounted to the mounting position.

According to a further aspect, the first urging portion (b) urges the first urged portion (e), and the second urging portion (b) urges the second urged portion (e), after the cover member (15) is closed to a predetermined angle.

According to a further aspect, after completion of the movement of the cartridge (B) to the mounting position, the first urging portion (b) and the first urged portion (e) are away from each other, and the second urging portion (b) and the second urged portion (e) are away from each other.

According to a further aspect, the main assembly of the apparatus is provided with a main-assembly-side regulating portion (44*b*) for limiting entering of the first positioning portion (18*a*) and the second positioning portion (18*a*) to the mounting position, and the first positioning portion (18*a*) and the second positioning portion (18*a*) contact the main-assembly-side regulating portion (44*b*), the first urging portion (b) urges the first urged portion (e), and the second urging portion (b) urges the second urged portion (e) so that first positioning portion (18*a*) and the second positioning portion (18*a*) enter the main-assembly-side positioning portion (44*a*, 44*a*).

According to a further aspect, the regulating portion is in the form of a projection (44*b*) or a spring (45) disposed at an entrance of the main-assembly-side positioning portion (44*a*, 44*a*).

According to a further aspect, mounting of the cartridge (B) to the mounting position is completed prior to completion of closing of the to cover member (15) relative to the main assembly of the apparatus.

According to a further aspect, mounting of the cartridge (B) to the mounting position is completed in interrelation with a closing operation of the cover member (15) from its full-open position to a predetermined angle, and in a closing operation beyond the predetermined angle, the cartridge (B) is not moved; and in an opening operation of the cover member (15) from a closed position to a predetermined angle, the cartridge (B) is not moved, and in an opening operation beyond the predetermined angle, the cartridge (B) is moved to a taking-out position.

According to a further aspect, the first main-assembly-side guide (41) and the second main-assembly-side guide (41) are inclined downward substantially toward the mounting position.

According to a further aspect, the use may be made with a first plate (15*b*), which is rotatable about a center (15*a*) of rotation relative to first main-assembly fixed member (40) in interrelation with the opening and closing operation of the cover member (15), a first arcuate slot (15*c*1) provided in the first plate (15*b*), the slot being arcuate with a first radius, a second slot (15*c*2) radially outwardly extended from an end of the first arcuate slot (15*c*1) in the first plate (15*b*) toward a second radius, a first arcuate slot (40*b*1) formed in the main-assembly fixed member, and a second slot (40*b*2) radially inwardly extended from an end of the first arcuate slot (40*b*1) of the main-assembly-fixed member toward the first radius, a first engaging member (41*c*) movable in the first arcuate slot (15*c*1) of said first plate (15*b*), a second slot (15*c*2) of the first plate (15*b*), a first arcuate slot (40*b*1) of the main-assembly fixed member, and a second slot (40*b*2) of the main-assembly fixed member; wherein the first main-assembly-side guide (41) is moved by moving the first engaging member (41*c*) which is in the second slot (15*c*2) of the first plate (15*b*), in said first arcuate slot (15*c*1) of said first plate (15*b*) by moving the cover member (15) from its full-open position in a closing direction; and wherein when the first engaging member (41*c*) reaches the second slot (40*b*2) of the main assembly, the second slot (15*c*2) is moved with the first engaging member (41*c*) being at rest, so that the cover member (15) is closed without movement of the first main-assembly-side guide (41).

According to a further aspect, the cartridge (B) is moved to a taking-out position in interrelation with an opening operation of the cover member (15) while the first cartridge guide (18*b*) is supported on the first main-assembly-side guide (41), and the second cartridge guide (18*b*) is supported on the second main-assembly-side guide (41).

The operation of the devices according to the foregoing embodiments are as follows. First, the cover member 15 is opened. This moves the second main-assembly-side guide 41 to the cartridge inserting position (cartridge mounting-and-demounting position, or first position). Then, the operator grasps the cartridge B and places the first cartridge guide 18*b* of the process cartridge on the first main-assembly-side guide 41. The operator also places the second cartridge guide 18*b* on the second main-assembly-side guide 41. The first and second cartridge guides 18*b* slide on the first and second main-assembly-side guides 41 toward the rear side by the pushing force of the operator and/or the weight of the cartridge B. The cartridge B stops by abutment of the abutting portion f of the second cartridge guide 18*b* to the guide regulating portion c. At this time, first urged portion e is opposed to the first urging portion b. Similarly, the second urged portion e is opposed to the second urging portion b. When the cover member 15 closes through a predetermined angle, the positioning portion 18*b* abuts the main-assembly-side regulating portion 45. This applies a movement load to the cartridge B. In interrelation with further closing action of the cover member 15, the first urging portion b pushes the first urged portion e. Similarly, the second urging portion b pushes the second urged portion e. By this, the cartridge B is moved further rearward. The cartridge positioning portion 18*a* is engaged with the main assembly positioning portion 44*a*. Thus, the cartridge B is mounted to the mounting position of the main assembly 14 of the apparatus.

When the cartridge B is to be taken out of the main assembly 14 of the apparatus, the operation is opposite from that described above as follows. In interrelation with the opening operation of the cover member, the first and second main-assembly-side guides 41 are moved to the cartridge insertion position (cartridge mounting-and-demounting position, or the first position). The operator grasps the cartridge B and takes it out of the main assembly 14.

By this, the cartridge B can be moved to the mounting position from the cartridge insertion position in interrelation with the closing operation of the cover member. In interrelation with the opening operation of the cover member, the cartridge B may be moved from the mounting position to the cartridge insertion position. By the operator inserting the cartridge B at the front side of the main assembly of the apparatus (closer side to the operator), the cartridge is moved toward the rear side from the front side by closing the cover member 15. Additionally, by the operator opening the cover member 15, the cartridge is moved from the rear side to the front side (closer to the operator).

Further Embodiments

In the foregoing embodiments, the main-assembly-side regulating portion 44*b* provided on the guide 44 enters the movement locus of the positioning portion 18*a* with respect to the positioning portion 44*a* in order to engage the positioning portion 18*a* of the process cartridge B with the main-assembly-positioning portion 44*a* of the positioning guide 44 provided on the main-assembly fixed member 40, 62. However, in order to more positively engage the positioning portion 18*a* of the process cartridge B with the main assembly positioning portion 44*a*, the positioning guide 44 may provided with a twist coil spring 45 (an elastic member having a bent portion 45*a* (having an "L" shaped bent shape, as shown in FIG. 22)) such that the bent portion 45*a* enters the movement locus of the positioning portion 18*a*.

Figure 22:
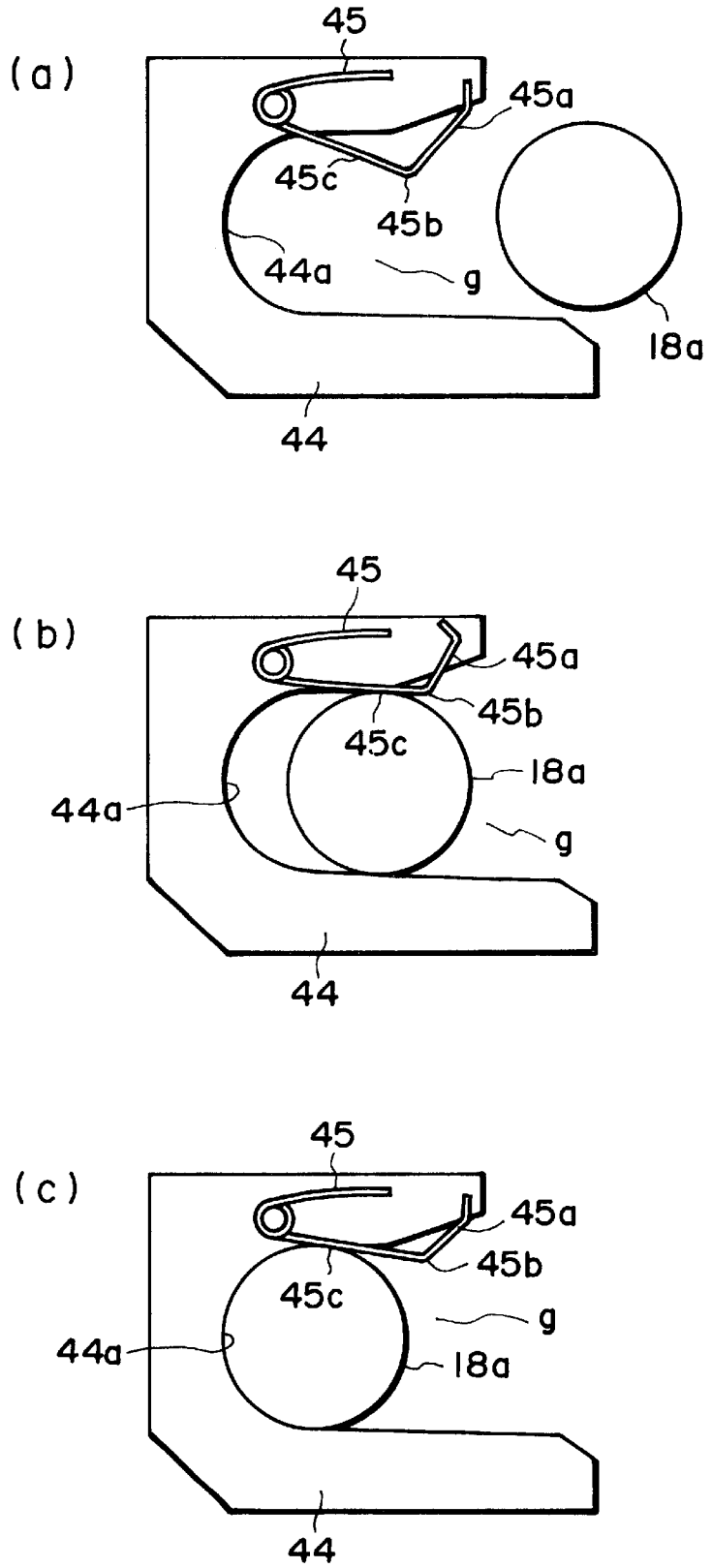
FIG. 22 is an illustration of a positioning guide according to another embodiment of the present invention.
Figure 23:
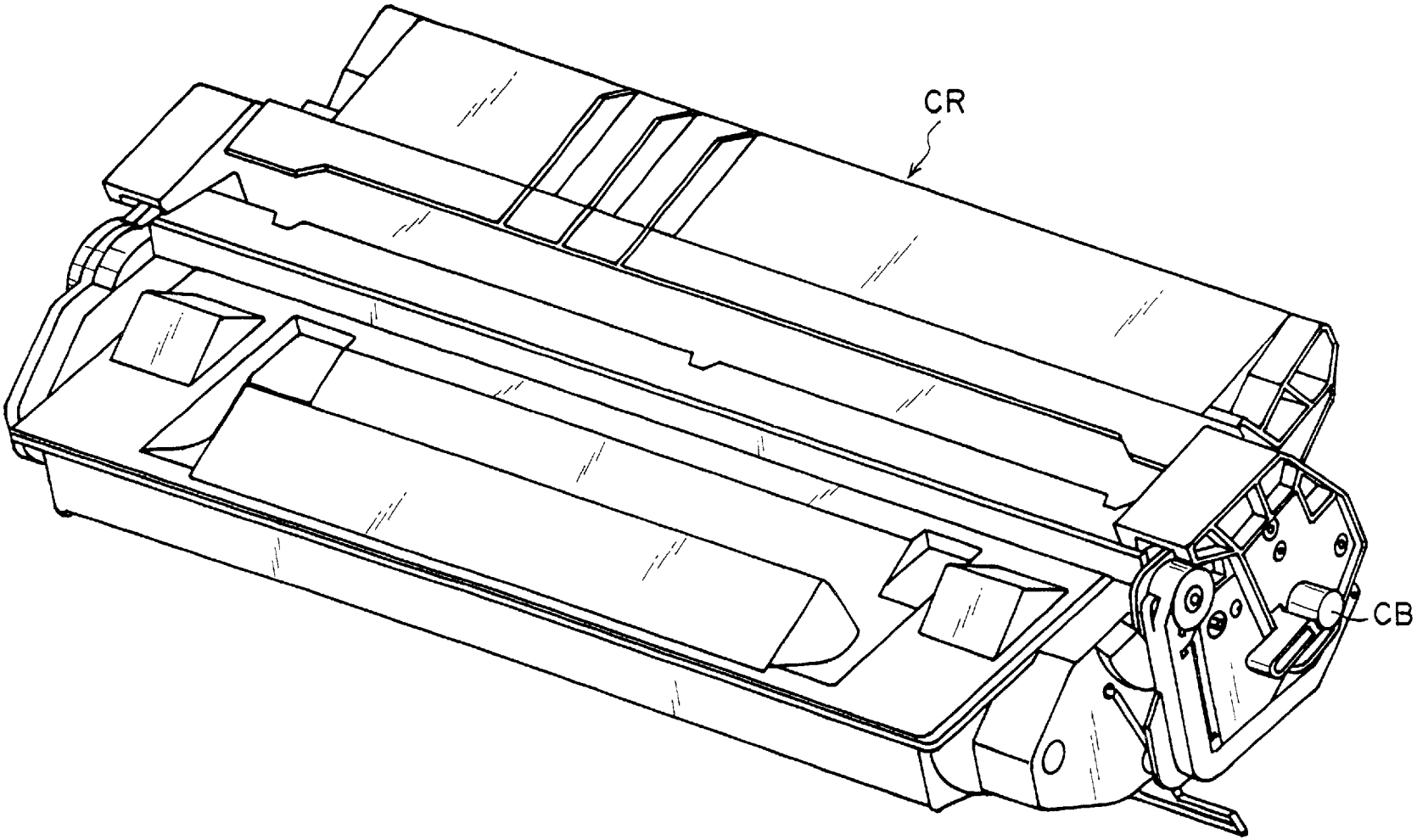
FIG. 23 (PRIOR ART)
FIG. 23 is a perspective view of a process cartridge detachably mountable to a cartridge mounting guide of a main assembly of a conventional electrophotographic image forming apparatus.
Figure 24:
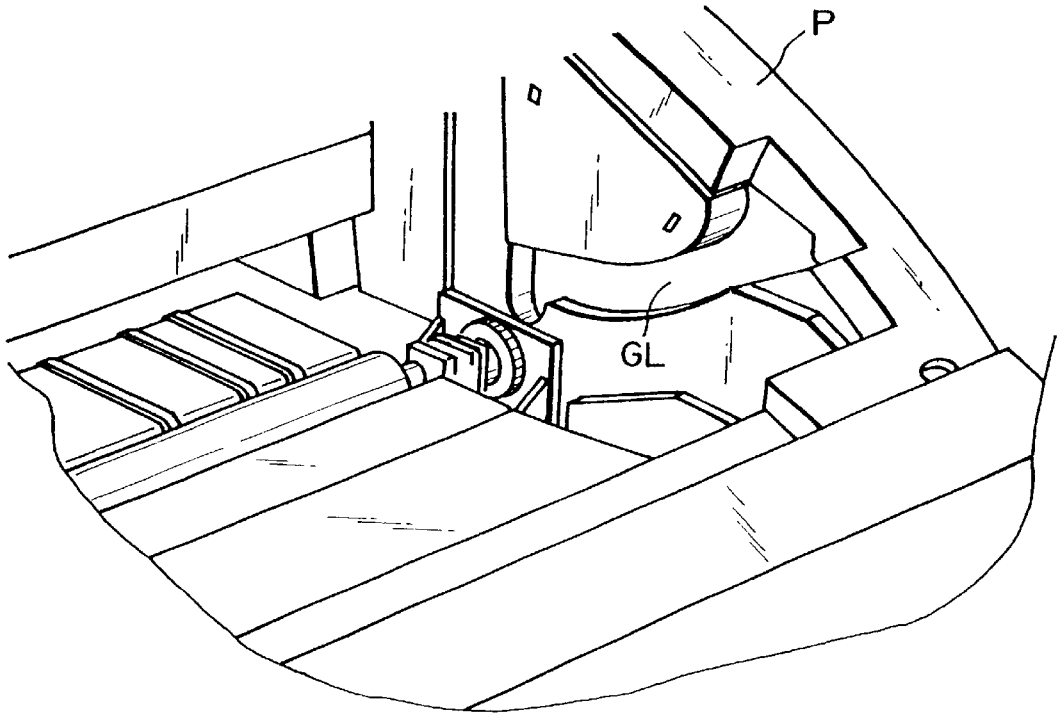
FIG. 24 (PRIOR ART)
FIG. 24 is an illustration of a cartridge mounting guide of a main assembly of a conventional electrophotographic image forming apparatus.
Figure 25:
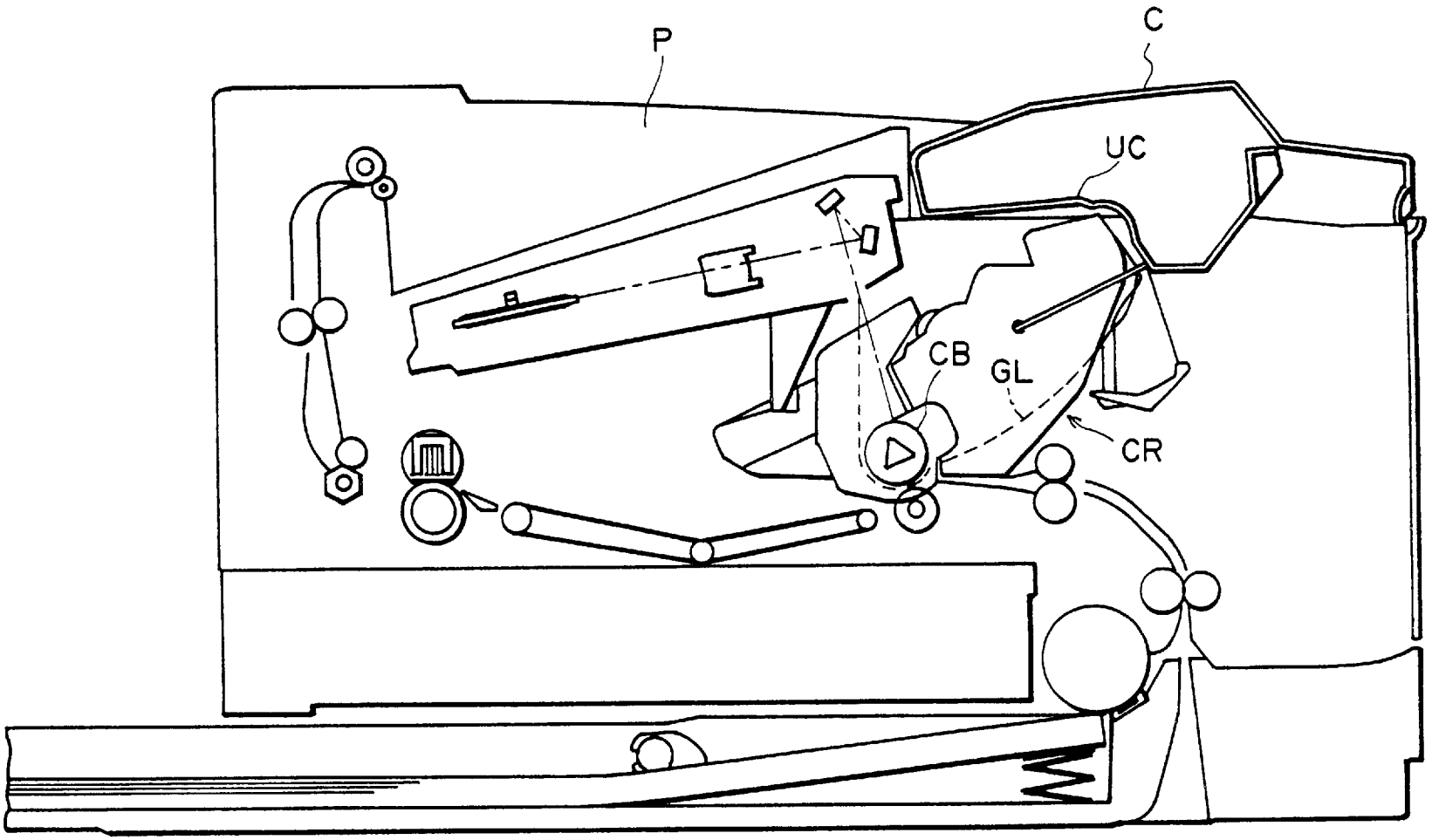
FIG. 25 (PRIOR ART)
FIG. 25 is an illustration of a back cover and a cartridge mounting guide of a main assembly of a conventional electrophotographic image forming apparatus.

In such a positioning guide 44, when the positioning portion 18*a* approaches the main-assembly-side positioning portion 44*a* of the positioning guide 44 with the movement of the process cartridge B along the main-assembly-side guide 41 (FIG. 22 (a)), the outer diameter of the positioning portion 18*a* contacts the bent point of the bent portion 45*a* of the twist coil spring 45. By the movement of the process cartridge B, the positioning portion 18*a* causes an elastic deformation of the bent portion 45*a* of the twist coil spring 45 upwardly, so as to escape from the movement locus of the positioning portion 18*a*. When the positioning portion 18*a* passes by the bent point 45*b* of the twist coil spring 45, the restoring force (elastic force) stored in the twist coil spring 45 by the retraction of the bent portion 45*a* functions to press the positioning portion 18*a* to the positioning portion 44*a* of the positioning guide 44 (FIG. 22, (c)). The arm portion 45*c* of the twist coil spring 45 functions to contact the positioning portion 18*a* closely to the main assembly positioning portion 44*a* with a predetermined pressure, so that the positioning boss 2 of the process cartridge B is raised from the positioning guide 44 by the contact force of the transfer roller 4 to the photosensitive drum 7. By using such a positioning guide 44, the positioning portion 18*a* of the process cartridge B can be more positively fixed to the positioning guide 44.

The process cartridge in the first embodiment was of a type which formed a monochromatic image. However, the present invention is preferably applicable not only to a process cartridge which forms a monochromatic image, but also to a process cartridge which comprises multiple developing means and forms a multi-color image (for example, a two-color image, a three-color image, or a full-color image).

Also, the electrophotographic photosensitive member is not limited to the photosensitive drum alone. For example, the following may be included. First, as for the photosensitive material, photoconductive material, amorphous silicon, amorphous selenium, zinc oxide, titanium oxide, or organic photoconductive material, may be included. As for the configuration of the base on which the photosensitive material is coated, a rotary configuration such as a drum shape, or a flat configuration such as a belt shape, may be included.

Also, the present invention is preferably usable with various known developing methods such as the magnetic brush developing method using two component toner, the cascade developing method, the touch-down developing method, and the cloud developing method.

However, another method, such as corona charging, is usable, in which a tungsten wire is enclosed by metal shield of aluminum or the like at three sides of the wire, and positive or negative ions are produced by applying a high voltage to the tungsten wire, and the surface of the photosensitive drum is uniformly charged by moving positive or negative ions to the surface.

The charging means may be of a blade type (charge blade), a pad type, a block type, a rod type, or a wire type, in addition to the aforementioned roller type.

The means for cleaning the toner remaining on the photosensitive drum may be of a blade type, a fur brush type, a magnetic brush type, or the like.

The process cartridge contains the electrophotographic photosensitive member and at least one process means. One type of the process cartridge contains the electrophotographic photosensitive member and the charging means as a unit or cartridge, which is detachably mountable to the main assembly of the apparatus. Another type of the process cartridge contains the electrophotographic photosensitive member and the developing means as a unit or a cartridge which is detachably mountable to the main assembly of the apparatus. A further type contains the electrophotographic photosensitive member and the cleaning means as a unit or a cartridge, which is detachably mountable to the main assembly of the apparatus. A further type of the process cartridge contains the electrophotographic photosensitive member and at least two process means as a unit or a cartridge, which is detachably mountable to the main assembly of the apparatus.

For example, the process cartridge may contain the electrophotographic photosensitive member and the charging means, the developing means or the cleaning means, which are unified into a cartridge which is detachably mountable to the main assembly of the apparatus. Another type contains at least one of the charging means, the developing means and the cleaning means as a unit or a cartridge which is detachably mountable to the main assembly of the image forming apparatus. Furthermore, it may contain at least the developing means and the electrophotographic photosensitive member as a unit or a cartridge, which is detachably mountable to the main assembly of the image forming apparatus. The process cartridge can be mounted to or demounted from the main assembly of the apparatus by the user. This means that that user can carry out the maintenance operation in effect.

Further, in the preceding embodiments, an electrophotographic image forming apparatus was exemplified by an electrophotographic laser beam printer, but the present invention does not need to be limited to the preceding embodiments. It is obvious that the present invention is also applicable to other electrophotographic image forming apparatuses such as an electrophotographic LED printer, an electrophotographic copying machine, an electrophotographic facsimile apparatus, or an electrophotographic word processor.

As described in the foregoing, the present invention improves the mounting operability of the process cartridge relative to the main assembly of the electrophotographic image forming apparatus.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge mounting mechanism for mounting a process cartridge to a mounting position in a main assembly of an electrophotographic image forming apparatus, wherein said cartridge comprises an electrophotographic photosensitive member and process means actable on said photosensitive member, said process cartridge mounting mechanism comprising:

an openable cover member mounted to the main assembly of the apparatus, said cover member being opened and closed when said cartridge is mounted to or demounted from the main assembly of the apparatus;

a first main assembly side guide which is provided in the main assembly of the apparatus and which is movable in interrelation with opening and closing operations of said cover member, said first main assembly side guide including a first supporting portion and a first urging portion;

a second main assembly side guide which is provided in the main assembly of the apparatus and which is movable in interrelation with opening and closing operations of said cover member, said second main assembly side guide including a second supporting portion and a second urging portion;

a first positioning portion, provided in said cartridge at one longitudinal end of a cartridge frame, for positioning said cartridge to said mounting position, wherein said first positioning portion is engaged with a main assembly side positioning portion provided in the main assembly;

a first cartridge guide, provided at a position away from said first positioning portion in said cartridge at one longitudinal end of the cartridge frame, for guiding said cartridge toward said mounting position, said first cartridge guide including a first supported portion to be supported on said first supporting portion and a first urged portion to be urged to said first urging portion;

a second positioning portion, provided at said cartridge at the other longitudinal end of the cartridge frame, for positioning said cartridge to said mounting position, wherein when said process cartridge is mounted to the mounting position, said second positioning portion is engaged with the main assembly side positioning portion provided in the main assembly; and a second cartridge guide, provided at a position away from said second positioning portion in said cartridge at the other longitudinal end of the cartridge frame, for guiding said cartridge toward said mounting position, said second cartridge guide including a second supported portion to be supported on said second supporting portion and a second urged portion to be urged to said second urging portion;

wherein said cartridge is mounted to the mounting position in interrelation with a closing operation of said cover member.

2. A process cartridge mounting mechanism according to claim 1, wherein said first cartridge guide includes an abutting portion for abutting to a guide regulating portion provided in said first supporting portion, said abutting portion being provided at a front end of said first cartridge guide in a mounting direction of said cartridge; and said second cartridge guide includes an abutting portion for abutting to a guide regulating portion provided in said second supporting portion, said abutting portion of said second cartridge guide being provided at a front end of said second cartridge guide in the mounting direction of said cartridge.

3. A process cartridge mounting mechanism according to claim 1 or 2, wherein said first urged portion and said first supported portion are integrally molded, and said second urged portion and said second supported portion are integrally molded.

4. A process cartridge mounting mechanism according to claim 1 or 2, wherein said first cartridge guide is projected outwardly from a cartridge frame portion provided at one longitudinal end of said cartridge frame, and said first cartridge guide is integrally molded with said cartridge fame; and said second cartridge guide is projected outwardly from a cartridge frame portion provided at the other longitudinal end of said cartridge frame, and said second cartridge guide is integrally molded with said cartridge frame.

5. A process cartridge mounting mechanism according to claim 1, wherein said photosensitive member is in the form of a drum, and wherein said first positioning portion and second positioning portion are coaxial with said photosensitive drum.

6. A process cartridge mounting mechanism according to claim 1 or 5, wherein said first cartridge guide and said second cartridge guide are so disposed that said first cartridge guide is above said first positioning portion in a vertical direction, and said second cartridge guide is above said second positioning portion, when said cartridge is mounted to the mounting position.

7. A process cartridge mounting mechanism according to claim 1, wherein said first urging portion urges said first urged portion, and said second urging portion urges said second urged portion, after said cover member is closed at a predetermined angle.

8. A process cartridge mounting mechanism according to claim 7, wherein after completion of movement of said cartridge to the mounting position, said first urging portion and said first urged portion are away from each other, and said second urging portion and said second urged portion are away from each other.

9. A process cartridge mounting mechanism according to claim 1, wherein the main assembly of said apparatus is provided with a main assembly side regulating portion for limiting entering of said first positioning portion and said second positioning portion to the mounting position, and said first positioning portion and said second positioning portion are contacted to said main assembly side regulating portion, said first urging portion urges said first urged portion, and said second urging portion urges said second urged portion so that said first positioning portion and said second positioning portion enter the main assembly side positioning portion.

10. A process cartridge mounting mechanism according to claim 9, wherein said main assembly side regulating portion is in the form of a projection or a spring disposed at an entrance of said main assembly side positioning portion.

11. A process cartridge mounting mechanism according to claim 1, wherein mounting of said cartridge to the mounting position is completed prior to completion of closing of said cover member relative to the main assembly of the apparatus.

12. A process cartridge mounting mechanism according to claim 1, wherein said first main assembly side guide and second main assembly side guide are inclined downward substantially toward the mounting position.

13. A process cartridge mounting mechanism according to claim 1, wherein mounting of said cartridge to the mounting position is completed in interrelation with a closing operation of said cover member from its full-open position to a predetermined angle, and in a closing operation beyond the predetermined angle, said cartridge is not moved; and in an opening operation of said cover member from a closed position to a predetermined angle, said cartridge is not moved, and in an opening operation beyond the predetermined angle, said cartridge is moved to a taking-out position.

14. A process cartridge mounting mechanism according to claim 1 or 13, further comprising a first plate which is rotatable about a center of rotation relative to a main assembly fixed member in interrelation with the opening and closing operation of said cover member, a first arcuate slot provided in said first plate, said first arcuate slot being arcuate with a first radius, a second slot radially outwardly extended from an end of said first arcuate slot in said first plate toward a second radius, a first arcuate slot formed in said main assembly fixed member and extending with a constant distance equal to said second radius from the center of rotation, and a second slot radially inwardly extended from an end of said first arcuate slot of said main assembly fixed member toward said first radius, a first engaging member movable in said first arcuate slot of said first plate, said second slot of said first plate, said first arcuate slot of said main assembly fixed member, and said second slot of the main assembly fixed member; wherein said first main assembly side guide is moved by moving said first engaging member which is in said second slot of said main assembly fixed member, in said first arcuate slot of said main assembly fixed member by moving said cover member from its full-open position in a closing direction; and wherein when said first engaging member reaches said first slot of said first plate, said second slot of the main assembly fixed member is moved with said first engaging member being at rest, so that said cover member is closed without movement of said first main assembly side guide.

15. A process cartridge mounting mechanism according to claim 1, wherein said cartridge is moved to a talking-out position in interrelation with an opening operation of said cover member while said first cartridge guide is supported on said first main assembly side guide, and said second cartridge guide is supported on said second main assembly side guide.

16. An electrophotographic image forming apparatus for forming an image on a recording material, to which a process cartridge is detachably mountable, said apparatus comprising:

(a) an openable cover member mounted to a main assembly of the apparatus, said cover member being opened and closed when said cartridge is mounted to or demounted from the main assembly of the apparatus;

(b) a first main assembly side guide which is provided in the main assembly of the apparatus and which is movable in interrelation with opening and closing operations of said cover member, said first main assembly side guide including a first supporting portion and a first urging portion;

(c) a second main assembly side guide which is provided in the main assembly of the apparatus and which is movable in interrelation with opening and closing operations of said cover member, said second main assembly side guide including a second supporting portion and a second urging portion;

(d) mounting means for detachably mounting the process cartridge, said process cartridge including:

an electrophotographic photosensitive member;

process means actable on said electrophotographic photosensitive member;

a first positioning portion, provided in said cartridge at one longitudinal end of a cartridge frame, for positioning said cartridge to a mounting position, wherein said first positioning portion is engaged with a main assembly side positioning portion provided in the main assembly;

a first cartridge guide, provided at a position away from said first positioning portion in said cartridge at one longitudinal end of the cartridge frame, for guiding said cartridge toward said mounting position, said first cartridge guide including a first supported portion to be supported on said first supporting portion and a first urged portion to be urged to said first urging portion;

a second positioning portion, provided at said cartridge at the other longitudinal end of the cartridge frame, for positioning said cartridge to said mounting position, wherein when said process cartridge is mounted to the mounting position, said second positioning portion is engaged with the main assembly side positioning portion provided in the main assembly; and a second cartridge guide, provided at a position away from said second positioning portion in said cartridge at the other longitudinal end of the cartridge frame, for guiding said cartridge toward said mounting position, said second cartridge guide including a second supported portion to be supported on said second supporting portion and a second urged portion to be urged to said second urging portion;

wherein said cartridge is mounted to the mounting position in interrelation with a closing operation of said cover member.

17. An apparatus according to claim 16, wherein said first cartridge guide includes an abutting portion for abutting to a guide regulating portion provided in said first supporting portion, said abutting portion being provided at a front end of said first cartridge guide in a mounting direction of said cartridge; and said second cartridge guide includes an abutting portion for abutting to a guide regulating portion provided in said second supporting portion, said abutting portion of said second cartridge guide being provided at a front end of said second cartridge guide in the mounting direction of said cartridge.

18. An apparatus according to claim 16 or 17, wherein said first urged portion and said first supported portion are integrally molded, and said second urged portion and said second supported portion are integrally molded.

19. An apparatus according to claim 16 or 17, wherein said first cartridge guide is projected outwardly from a cartridge frame portion provided at one longitudinal end of said cartridge frame, and said first cartridge guide is integrally molded with said cartridge frame; and said second cartridge guide is projected outwardly from a cartridge frame portion provided at the other longitudinal end of said cartridge frame, and said second cartridge guide is integrally molded with said cartridge frame.

20. An apparatus according to claim 16, wherein said photosensitive member is in the form of a drum, and wherein said first positioning portion and second positioning portion are coaxial with said photosensitive drum.

21. An apparatus according to claim 16 or 20, wherein said first cartridge guide and said second cartridge guide are so disposed that said first cartridge guide is above said first positioning portion in a vertical direction, and said second cartridge guide is above said second positioning portion, when said cartridge is mounted to the mounting position.

22. An apparatus according to claim 16, wherein said first urging portion urges said first urged portion, and said second urging portion urges said second urged portion, after said cover member is closed at a predetermined angle.

23. An apparatus according to claim 22, wherein after completion of movement of said cartridge to the mounting position, said first urging portion and said first urged portion are away from each other, and said second urging portion and said second urged portion are away from each other.

24. An apparatus according to claim 16, 20, 22, or 23, wherein the main assembly of said apparatus is provided with a main assembly side regulating portion for limiting entering of said first positioning portion and said second positioning portion to the mounting position, and said first positioning portion and said second positioning portion are contacted to said main assembly side regulating portion, said first urging portion urges said first urged portion, and said second urging portion urges said second urged portion so that said first positioning portion and said second positioning portion enter the main assembly side positioning portion.

25. An apparatus according to claim 24, wherein said main assembly side regulating portion is in the form of a projection or a spring disposed at an entrance of said main assembly side positioning portion.

26. An apparatus according to claim 17, wherein mounting of said cartridge to the mounting position is completed prior to completion of closing of said cover member relative to the main assembly of the apparatus.

27. An apparatus according to claim 16, wherein mounting of said cartridge to the mounting position is completed in interrelation with a closing operation of said cover member from its full-open position to a predetermined angle, and in a closing operation beyond the predetermined angle, said cartridge is not moved; and in an opening operation of said cover member from a closed position to a predetermined angle, said cartridge is not moved, and in an opening operation beyond the predetermined angle, said cartridge is moved to a taking-out position.

28. An apparatus according to claim 16 or 27, further comprising a first plate which is rotatable about a center of rotation relative to a main assembly fixed member in interrelation with the opening and closing operation of said cover member, a first arcuate slot provided in said first plate, said slot being arcuate with a first radius, a second slot radially outwardly extended from an end of said first arcuate slot in said first plate toward a second radius, a first arcuate slot formed in said main assembly fixed member and extending with a constant distance substantially equal to said second radius from the center of rotation, and a second slot radially inwardly extended from an end of said first arcuate slot of said main assembly fixed member toward said first radius, a first engaging member movable in said first arcuate slot of said first plate, said second slot of said first plate, said first arcuate slot of said main assembly fixed member, and said second slot of the main assembly fixed member; wherein said first main assembly side guide is moved by moving said first engaging member which is in said second slot of said first plate, in said first arcuate slot of said main assembly fixed member by moving said cover member from its full-open position in a closing direction; and wherein when said first engaging member reaches said second slot of the main assembly fixed member, said first slot of said first plate is moved with said first engaging member being at rest, so that said cover member is closed without movement of said first main assembly side guide.

29. An apparatus according to claim 16, wherein said first main assembly side guide and second main assembly side guide are inclined downward substantially toward the mounting position.

30. An apparatus according to claim 16, wherein said cartridge is moved to a taking-out position in interrelation with an opening operation of said cover member while said first cartridge guide is supported on said first main assembly side guide, and said second cartridge guide is supported on said second main assembly side guide.

31. A process cartridge detachably mountable to a main assembly of an electrophotographic image forming apparatus for forming an image on a recording material, said image forming apparatus including an openable cover member mounted to the main assembly of the apparatus, said cover member being opened and closed when said cartridge is mounted to or demounted from the main assembly of the apparatus; a first main assembly side guide which is provided in the main assembly of the apparatus and which is movable in interrelation with opening and closing operations of said cover member, said first main assembly side guide including a first supporting portion and a first urging portion; and a second main assembly side guide which is provided in the main assembly of the apparatus and which is movable in interrelation with opening and closing operations of said cover member, said second main assembly side guide including a second supporting portion and a second urging portion, wherein said process cartridge comprises:

an electrophotographic photosensitive member;

process means actable on said photosensitive member;

a cartridge frame;

a first positioning portion, provided in said cartridge at one longitudinal end of said cartridge frame, for positioning said cartridge to a mounting position, wherein said first positioning portion is engaged with a main assembly side positioning portion provided in the main assembly;

a first cartridge guide, provided at a position away from said first positioning portion in said cartridge at one longitudinal end of said cartridge frame, for guiding said cartridge toward said mounting position, said first cartridge guide including a first supported portion to be supported on said first supporting portion and a first urged portion to be urged to said first urging portion;

a second positioning portion, provided at said cartridge at the other longitudinal end of said cartridge frame, for positioning said cartridge to said mounting position, wherein when said process cartridge is mounted to the mounting portion, said second positioning portion is engaged with the main assembly side positioning portion provided in the main assembly; and a second cartridge guide, provided at a position away from said second positioning portion in said cartridge at the other longitudinal end of said cartridge frame, for guiding said cartridge toward said mounting position, said second cartridge guide including a second supported portion to be supported on said second supporting portion and a second urged portion to be urged to said second urging portion;

wherein said cartridge is mounted to the mounting position in interrelation with a closing operation of said cover member.

32. A process cartridge according to claim 31, wherein said first cartridge guide includes an abutting portion for abutting to a guide regulating portion provided in said first supporting portion, said abutting portion being provided at a front end of said first cartridge guide in a mounting direction of said cartridge; and said second cartridge guide includes an abutting portion for abutting to a guide regulating portion provided in said second supporting portion, said abutting portion of said second cartridge guide being provided at a front end of said second cartridge guide in a mounting direction of said cartridge.

33. A process cartridge according to claim 31 or 32, wherein said first urged portion and said first supported portion are integrally molded, and said second urged portion and said second supported portion are integrally molded.

34. A process cartridge according to claim 31 or 32, wherein said first cartridge guide is projected outwardly from a cartridge frame portion provided at one longitudinal end of said cartridge frame, and said first cartridge guide is integrally molded with said cartridge frame; and said second cartridge guide is projected outwardly from a cartridge frame portion provided at the other longitudinal end of said cartridge frame, and said second cartridge guide is integrally molded with said cartridge frame.

35. A process cartridge according to claim 31 or 32, wherein said photosensitive member is in the form of a drum, and wherein said first positioning portion and second positioning portion are coaxial with said photosensitive drum.

36. A process cartridge according to claim 31 or 32, wherein said first cartridge guide and said second cartridge guide are so disposed that said first cartridge guide is above said first positioning portion in a vertical direction, and said second cartridge guide is above said second positioning portion, when said cartridge is mounted to the mounting position.

37. A process cartridge according to claim 31, wherein said first urging portion urges said first urged portion, and said second urging portion urges said second urged portion, after said cover member is closed at a predetermined angle.

38. A process cartridge according to claim 37, wherein after completion of movement of said cartridge to the mounting position, said first urging portion and said first urged portion are away from each other, and said second urging portion and said second urged portion are away from each other.

39. A process cartridge according to claim 31, wherein mounting of said cartridge to the mounting position is completed in interrelation with a closing operation of said cover member from its full-open position to a predetermined angle, and in a closing operation beyond the predetermined angle, said cartridge is not moved; and in an opening operation of said cover member from a closed position to a predetermined angle, said cartridge is not moved, and in an opening operation beyond the predetermined angle, said cartridge is moved to a taking-out position.

40. A process cartridge according to claim 31, wherein said cartridge is moved to a taking-out position in interrelation with an opening operation of said cover member while said first cartridge guide is supported on said first main assembly side guide, and said second cartridge guide is supported on said second main assembly side guide.

41. A process cartridge according to claim 31, wherein said process means includes at least one of developing means, cleaning means and charging means.

42. A process cartridge mounting mechanism for mounting a process cartridge to a mounting position in a main assembly of an electrophotographic image forming apparatus, wherein said cartridge comprises an electrophotographic photosensitive member and process means actable on said photosensitive member, said process cartridge mounting mechanism comprising:

an openable cover member mounted to the main assembly of the apparatus, said cover member being opened and closed when said cartridge is mounted to or demounted from the main assembly of the apparatus;

a first main assembly side guide which is provided in the main assembly of the apparatus and which is movable in interrelation with opening and closing operations of said cover member, said first main assembly side guide including a first supporting portion and a first urging portion;

a second main assembly side guide which is provided in the main assembly of the apparatus and which is movable in interrelation with opening and closing operations of said cover member, said second main assembly side guide including a second supporting portion and a second urging portion;

a first cartridge guide, provided in said cartridge at one longitudinal end of a cartridge frame, for guiding said cartridge toward a mounting position said first cartridge guide including a first supported portion to be supported on said first supporting portion and a first urged portion to be urged to said first urging portion;

a second cartridge guide, provided in said cartridge at the other longitudinal end of the cartridge frame, for guiding said cartridge toward said mounting position, said second cartridge guide including a second supported portion to be supported on said second supporting portion and a second urged portion to be urged to said second urging portion;

wherein said cartridge is mounted to the mounting position in interrelation with a closing operation of said cover member;

wherein one longitudinal end of said cartridge frame is provided with a first positioning portion for positioning said cartridge to said mounting positions and the other longitudinal end of said cartridge frame is provided with a second positioning portion for positioning said cartridge to said mounting position, wherein said first positioning portion and second positioning portion are engaged with a main assembly side positioning portion provided in the main assembly; and wherein the main assembly of said apparatus is provided with a main assembly side regulating portion for limiting entering of said first positioning portion and said second positioning portion to the mounting position, and said first positioning portion and said second positioning portion are contacted to said main assembly side regulating portion, said first urging portion urges said first urged portion, and said second urging portion urges said second urged portion so that said first positioning portion and said second positioning portion enter the main assembly side positioning portion.

43. An electrophotographic image forming apparatus for forming an image of a recording material, to which a process cartridge is detachably mountable, said apparatus comprising:

(a) an openable cover member mounted to a main assembly of the apparatus, said cover member being opened and closed when said cartridge is mounted to or demounted from the main assembly of the apparatus;

(b) a first main assembly side guide which is provided in the main assembly of the apparatus and which is movable in interrelation with opening and closing operations of said cover member, said first main assembly side guide including a first supporting portion and a first urging portion;

(c) a second main assembly side guide which is provided in the main assembly of the apparatus and which is movable in interrelation with opening and closing operations of said cover member, said second main assembly side guide including a second supporting portion and a second urging portion; and (d) mounting means for mounting the process cartridge, said process cartridge including:

process means actable on an electrophotographic photosensitive member;

a first cartridge guide, provided in said cartridge at one longitudinal end of a cartridge frame, for guiding said cartridge toward a mounting position, said first cartridge guide including a first supported portion to be supported on said first supporting portion and a first urged portion to be urged to said first urging portion; and a second cartridge guide, provided in said cartridge at the other longitudinal end of the cartridge frame, for guiding said cartridge toward said mounting position, said second cartridge guide including a second supported portion to be supported on said second supporting portion and a second urged portion to be urged to said second urging portion;

wherein said cartridge is mounted to the mounting position in interrelation with a closing operation of said cover member, wherein one longitudinal end of said cartridge frame is provided with a first positioning portion for positioning said cartridge to said mounting position, and the other longitudinal end of said cartridge frame is provided with a second positioning portion for positioning said cartridge to said mounting position, wherein said first positioning portion and said second positioning portion are engaged with a main assembly side positioning portion provided in the main assembly, wherein the main assembly of said apparatus is provided with a main assembly side regulating portion for limiting entering of said first positioning portion and said second positioning portion to the mounting position, and said first positioning portion and said second positioning portion are contacted to said main assembly side regulating portion, said first urging portion urges said first urged portion, and said second urging portion urges said second urged portion so that said first positioning portion and said second positioning portion enter the main assembly side positioning portion.

44. An electrophotographic image forming apparatus for forming an image of a recording material, to which a process cartridge is detachably mountable, said apparatus comprising:

(a) an openable cover member mounted to a main assembly of the apparatus, said cover member being opened and closed when said cartridge is mounted to or demounted from the main assembly of the apparatus;

(b) a first main assembly side guide which is provided in the main assembly of the apparatus and which is movable in interrelation with opening and closing operations of said cover member, said first main assembly side guide including a first supporting portion and a first urging portion;

(c) a second main assembly side guide which is provided in the main assembly of the apparatus and which is movable in interrelation with opening and closing operations of said cover member, said second main assembly side guide including a second supporting portion and a second urging portion;

(d) mounting means for mounting the process cartridge, said process cartridge including:

process means actable on an electrophotographic photosensitive member;

a first cartridge guide, provided in said cartridge at one longitudinal end of a cartridge frame, for guiding said cartridge toward a mounting position, said first cartridge guide including a first supported portion to be supported on said first supporting portion and a first urged portion to be urged to said first urging portion; and a second cartridge guide, provided in said cartridge at the other longitudinal end of the cartridge frame, for guiding said cartridge toward said mounting position, said second cartridge guide including a second supported portion to be supported on said second supporting portion and a second urged portion to be urged to said second urging portion;

wherein said cartridge is mounted to the mounting position in interrelation with a closing operation of said cover member;

wherein mounting of said cartridge to the mounting position is completed in interrelation with a closing operation of said cover member from its full-open position to a predetermined angle, and in a closing operation beyond the predetermined angle, said cartridge is not moved; and in an opening operation of said cover member from a closed position to a predetermined angle, said cartridge is not moved, and in an opening operation beyond the predetermined angle, said cartridge is moved to a taking-out position;

(e) a first plate which is rotatable about a center of rotation relative to a main assembly fixed member in interrelation with the opening and closing operations of said cover member, wherein a first arcuate slot is provided in said first plate, said first arcuate slot being arcuate with a first radius, wherein a second slot radially outwardly extends from an end of said first arcuate slot in said first plate toward a second radius, wherein a first arcuate slot is formed in said main assembly fixed member, and a second slot radially inwardly extends from an end of said first arcuate slot of said main assembly fixed member toward said first radius; and (g) a first engaging member movable in said first arcuate slot of said first plate, said second slot of said first plate, said first arcuate slot of said main assembly fixed member, and said second slot of the main assembly fixed member;

wherein said first main assembly side guide is moved by moving said first engaging member which is in said second slot of said main assembly fixed member, in said first arcuate slot of said first plate by moving said cover member from its full-open position in a closing direction; and wherein when said first engaging member reaches said second slot of the main assembly fixed member, said first slot is moved with said first engaging member being at rest, so that said cover member is closed without movement of said first main assembly side guide.

* * * * *

UNITED STATES PATENT AND TRADEMARK OFFICE

CERTIFICATE OF CORRECTION

PATENT NO. : 6,735,406 B1
DATED : May 11, 2004
INVENTOR(S) : Shinya Noda

It is certified that error appears in the above-identified patent and that said Letters Patent is hereby corrected as shown below:

Title page,
Item [57], ABSTRACT,
Line 19, "interrelations" should read -- interrelationship --.

Column 1,
Line 26, "mountably" should read -- mountable --.

Column 7,
Line 52, "12*b*" should read -- 12*b,* --.

Column 12,
Line 7, "inevitable" should read -- essential --.
Line 44, "guide." should read -- guide --.

Column 16,
Line 48, "latitude" should read -- the latitude --.
Line 50, "hav" should read -- have --.
Line 62, "is:" should read -- is --.

Column 17,
Line 47, "desires in the world" should read -- objectives --.

Column 20,
Line 17, "is" should read -- are --.

Column 23,
Line 43, "to" (1st occurrence) should be deleted.
Line 60, "the" should be deleted.

Column 29,
Line 36, "talking-out" should read -- taking-out --.

Column 31,
Line 23, "claim 17," should read -- claim 16, --.

UNITED STATES PATENT AND TRADEMARK OFFICE

CERTIFICATE OF CORRECTION

PATENT NO. : 6,735,406 B1
DATED : May 11, 2004
INVENTOR(S) : Shinya Noda

It is certified that error appears in the above-identified patent and that said Letters Patent is hereby corrected as shown below:

Column 34,
Line 15, "position" should read -- position, --.

Signed and Sealed this

Twenty-third Day of November, 2004

JON W. DUDAS
*Director of the United States Patent and Trademark Office*